US011479978B2

(12) United States Patent
De Rick et al.

(10) Patent No.: US 11,479,978 B2
(45) Date of Patent: Oct. 25, 2022

(54) SET OF MUTUALLY LOCKABLE PANELS

(71) Applicant: Flooring Industries Limited, SARL, Bertrange (LU)

(72) Inventors: Jan Eddy De Rick, Geraardsbergen (BE); Bruno Paul Louis Vermeulen, Aldeneik-Maaseik (BE)

(73) Assignee: FLOORING INDUSTRIES LIMITED, SARL, Bertrange (LU)

( * ) Notice: Subject to any disclaimer, the term of this patent is extended or adjusted under 35 U.S.C. 154(b) by 0 days.

(21) Appl. No.: 17/306,472

(22) Filed: May 3, 2021

(65) Prior Publication Data

US 2021/0254350 A1 Aug. 19, 2021

Related U.S. Application Data

(63) Continuation of application No. 16/821,634, filed on Mar. 17, 2020, now Pat. No. 10,995,499, which is a (Continued)

(30) Foreign Application Priority Data

Mar. 24, 2014 (EP) ..... 14161364

(51) Int. Cl.
*E04F 15/02* (2006.01)
*E04F 13/08* (2006.01)
*E04F 15/10* (2006.01)

(52) U.S. Cl.
CPC .... *E04F 15/02038* (2013.01); *E04F 13/0889* (2013.01); *E04F 15/105* (2013.01); (Continued)

(58) Field of Classification Search
CPC ..... E04F 15/02038; E04F 15/105; E04F 13/0889; E04F 2201/0146; (Continued)

(56) References Cited

U.S. PATENT DOCUMENTS 7,603,826 B1 10/2009 Moebus
7,980,043 B2 7/2011 Moebus
(Continued)

FOREIGN PATENT DOCUMENTS

CN 2573601 Y 9/2003
CN 101910528 A 12/2010
(Continued)

OTHER PUBLICATIONS

European Office Action, dated Oct. 5, 2018, for European Patent Application No. 15713675.5-1002, filed Mar. 24, 2015.
(Continued)

*Primary Examiner* — Mark R Wendell
(74) *Attorney, Agent, or Firm* — Workman Nydegger

(57) ABSTRACT

A set of mutually lockable panels comprises a first panel having an edge including a male part and a second panel having an edge including a female part for receiving the male part of the first panel in unlocked condition of the panels. The male part has an outer side which, in locked condition of the panels, is directed to the second panel in a direction substantially parallel to the front face of the first panel, and an opposite inner side which is provided with a locking surface. The female part comprises a locking member, which is pivotable about a pivot axis that extends substantially parallel to the edge of the second panel and an actuator for rotating the locking member from its unlocked condition to a locked condition of the panels.

35 Claims, 17 Drawing Sheets

Related U.S. Application Data continuation of application No. 16/404,329, filed on May 6, 2019, now Pat. No. 10,612,250, which is a continuation of application No. 15/128,078, filed as application No. PCT/EP2015/056297 on Mar. 24, 2015, now Pat. No. 10,280,627, and a continuation of application No. 14/223,303, filed on Mar. 24, 2014, now Pat. No. 9,260,870.

(52) U.S. Cl.
CPC ..... *E04F 2201/0146* (2013.01); *E04F 2201/0153* (2013.01); *E04F 2201/041* (2013.01); *E04F 2201/049* (2013.01); *E04F 2201/0552* (2013.01)

(58) Field of Classification Search
CPC ..... E04F 2201/0153; E04F 2201/041; E04F 2201/049; E04F 2201/0552
USPC ..... 52/582.2
See application file for complete search history.

(56) References Cited

U.S. PATENT DOCUMENTS

| | | | |
|---|---|---|---|
| 8,353,140 | B2 | 1/2013 | Pervan |
| 8,365,499 | B2 | 2/2013 | Nilsson |
| 8,484,924 | B2 | 7/2013 | Braun |
| 8,499,521 | B2 | 8/2013 | Pervan et al. |
| 8,701,368 | B2 | 4/2014 | Vermeulen et al. |
| 8,720,150 | B2 | 5/2014 | Hannig |
| 8,820,014 | B2 | 9/2014 | Durnberger |
| 9,175,474 | B2 | 11/2015 | Hannig |
| 9,260,870 | B2 | 2/2016 | Vermeulen |
| 9,290,948 | B2 | 3/2016 | Cappelle et al. |
| 9,695,852 | B2 | 7/2017 | Hannig |
| 9,932,741 | B2 | 4/2018 | Cappelle et al. |
| 2001/0010139 | A1 | 8/2001 | De Kerpel |
| 2002/0170258 | A1 | 11/2002 | Schwitte et al. |
| 2004/0159066 | A1 | 8/2004 | Thiers et al. |
| 2005/0055972 | A1 | 3/2005 | Luty |
| 2005/0205161 | A1 | 9/2005 | Lewark |
| 2007/0028547 | A1 | 2/2007 | Grafenauer et al. |
| 2007/0107359 | A1 | 5/2007 | Zhang |
| 2008/0295432 | A1 | 12/2008 | Pervan et al. |
| 2009/0217615 | A1 | 3/2009 | Engstrom |
| 2009/0133353 | A1 | 5/2009 | Pervan |
| 2009/0193748 | A1 | 8/2009 | Boo et al. |
| 2009/0249733 | A1 | 10/2009 | Moebus |
| 2010/0218450 | A1* | 9/2010 | Braun ..... F16B 5/0056 52/745.21 |
| 2010/0293879 | A1 | 11/2010 | Pervan et al. |
| 2011/0016815 | A1 | 1/2011 | Yang |
| 2011/0056167 | A1 | 3/2011 | Nilsson |
| 2011/0131916 | A1 | 6/2011 | Chen et al. |
| 2011/0197535 | A1 | 8/2011 | Baker et al. |
| 2011/0271632 | A1 | 11/2011 | Cappelle et al. |
| 2012/0017533 | A1 | 1/2012 | Pervan et al. |
| 2012/0042598 | A1 | 2/2012 | Vermeulen et al. |
| 2012/0151865 | A1 | 6/2012 | Pervan et al. |
| 2012/0174520 | A1 | 7/2012 | Pervan |
| 2012/0279161 | A1 | 11/2012 | Hakansson et al. |
| 2012/0317916 | A1 | 12/2012 | Oh |
| 2013/0008119 | A1 | 1/2013 | Vermeulen |
| 2013/0019555 | A1 | 1/2013 | Pervan et al. |
| 2013/0025231 | A1 | 1/2013 | Vermeulen et al. |
| 2013/0036695 | A1 | 2/2013 | Durnberger |
| 2013/0111758 | A1 | 5/2013 | Nilsson |
| 2013/0145708 | A1 | 6/2013 | Pervan |
| 2013/0160391 | A1 | 6/2013 | Darko |
| 2013/0239508 | A1 | 9/2013 | Darko et al. |
| 2013/0276398 | A1 | 10/2013 | Hannig |
| 2013/0309441 | A1 | 11/2013 | Hannig |
| 2014/0007539 | A1 | 1/2014 | Darko |
| 2014/0237924 | A1 | 8/2014 | Nilsson |
| 2014/0283477 | A1 | 9/2014 | Hannig |
| 2015/0075105 | A1 | 3/2015 | Engstrom |
| 2015/0267418 | A1 | 9/2015 | Vermeulen |
| 2016/0215505 | A1 | 7/2016 | Cappelle et al. |
| 2017/0268545 | A1 | 9/2017 | Hannig |

FOREIGN PATENT DOCUMENTS

| | | | |
|---|---|---|---|
| CN | 202055464 | U | 11/2011 |
| CN | 102482888 | A | 4/2012 |
| CN | 102459780 | A | 5/2012 |
| CN | 103477004 | A | 12/2013 |
| DE | 29922649 | U1 | 4/2000 |
| DE | 29922649 | U1 | 8/2002 |
| DE | 202009004530 | U1 | 6/2009 |
| DE | 102009035275 | | 12/2010 |
| DE | 102011086846 | A1 | 8/2012 |
| DE | 202012007012 | U1 | 9/2012 |
| EP | 2063044 | | 5/2009 |
| EP | 1120515 | A1 | 8/2011 |
| KR | 20050015710 | A | 2/2005 |
| WO | 9822677 | A1 | 5/1998 |
| WO | 0020705 | A1 | 4/2000 |
| WO | 0102670 | A1 | 1/2001 |
| WO | 0102672 | A1 | 1/2001 |
| WO | 0148332 | A1 | 7/2001 |
| WO | 0166877 | A1 | 9/2001 |
| WO | 0177461 | A1 | 10/2001 |
| WO | 03012224 | A1 | 2/2003 |
| WO | 03025307 | A1 | 3/2003 |
| WO | 03074814 | A1 | 9/2003 |
| WO | 03078761 | A1 | 9/2003 |
| WO | 03087497 | A1 | 10/2003 |
| WO | 03089736 | A1 | 10/2003 |
| WO | 2004020764 | A1 | 3/2004 |
| WO | 2004053257 | A1 | 6/2004 |
| WO | 2004079130 | A1 | 9/2004 |
| WO | 2004083557 | A1 | 9/2004 |
| WO | 2004085765 | A1 | 10/2004 |
| WO | 2005054599 | A1 | 6/2005 |
| WO | 2006050928 | A1 | 5/2006 |
| WO | 2006104436 | A1 | 10/2006 |
| WO | 2006123988 | A1 | 11/2006 |
| WO | 2007089186 | | 8/2007 |
| WO | 2008017281 | A1 | 2/2008 |
| WO | 2008017301 | A1 | 2/2008 |
| WO | 2010070472 | | 6/2010 |
| WO | 2010070605 | | 6/2010 |
| WO | 2010082171 | | 7/2010 |
| WO | 2010108980 | | 9/2010 |
| WO | 2011012104 | A2 | 2/2011 |
| WO | 2011028171 | A1 | 3/2011 |
| WO | 2011085825 | | 7/2011 |
| WO | 2011151758 | | 12/2011 |

OTHER PUBLICATIONS

Chinese Office Action, dated Jul. 26, 2018 for Chinese Patent Application No. 201580014968.2, filed Mar. 24, 2014.

Notification of Transmittal of the International Search Report and the Written Opinion of the International Searching Authority, or the Declaration, dated Jul. 27, 2015 for International Patent Application No. PCT/EP2015/056297, filed Mar. 24, 2015.

Correspondence from German Patent and Trademark Office to Grunecker, Kinkeldey, Stockmair & Schanhausse forwarding cancellation request, dated Nov. 11, 2013, 2 pages (With Human Translation).

Valinge Innovation AB, Technical Disclosure entitled "Mechanical locking for floor panels with a flexible bristle tongue," IP.com No. IPCOM000145262D, Jan. 12, 2007, IP.com PriorArtDatabase, 57 pages.

Engstrand, Ola (Contact)/Valinge Innovation AB, Technical Disclosure entitled "VA-038 Mechanical Locking of Floor Panels With Vertical Folding," IP.com No. IPCOM000179246D, Feb. 10, 2009, IP.com PriorAriDatabase, 59 pages.

International Search Report dated Oct. 15, 2012 in PCT/SE2012/050828, Swedish Patent Office, Stockholm, Sweden, 7 pages.

(56) References Cited

OTHER PUBLICATIONS

Cancellation Request by Spanolux N.V Divisie Balterio, Inhaberin: Valinge Flooring Technology AB, Antragstellerin: Spanolux N.V. Divisie Baterio, Oct. 31, 2013, 75 pages, Bird & Bird LLP, Dusseldorf, DE. (With Human translation).
(Human) English-language translation of paragraphs 211-214 of Reply by Spanolux N.V. Divisie Balerio, Valinge-Fooring Technology AB gegen Spanolux N.V. Divisie Balterio, Bird & Bird LLP, Dusseldorf, DE, Sep. 17, 2013.
Spanolux N.V.—DIV Balterio, Priority Document for EP 11007573, Sep. 16, 2011, 20 pages, European Patent Office.
Engstrand. Ola (Contact)/Valinge Innovation AB. Technical Disclosure entitled "VA043 5G Linear Slide Tongue,"IP.com No. IPCOM000179015D, Feb. 4, 2009, IP.com Prior Art Database, 126 pages.
Engstrand, Ola (Contact)/Valinge Innovation AB, Technical Disclosure entitled "VA043b PCT Mechanical Locking of Floor Panels," IP.com No. IPCOM000189420D, Nov. 9, 2009, IP.com Prior Art Database, 62 pages.
Engstrand, Ola (Contact)/Valinge Innovation AB, Technical Disclosure entitled "VA055 Mechanical locking system for floor panels," IP com No. IPCOM000206454D, Apr. 27, 2011, IP.com Prior Art Database, 25 pages.
Engstrand, Ola (Contact)/Valinge Innovation AB, Technical Disclosure entitled "VA058 Rocker Tonge," IP com No. IPCOM000203832D, Feb. 4, 2011, IP.com Prior Art Database, 22 pages.
Pervan, Darko (Author)/Valinge Flooring Technology AB, Technical Disclosure entitled "VA066b Glued Tongue," IP com No. iPCOM000210865D, Sep. 13, 2011, IP.com Prior Art Database, 19 pages.
Pervan, Darko (Inventor)/Valinge Flooring Technology AB, Technical Disclosure entitled "VA067 Fold Slide Loe," IP com No. iPCOM000208542D, Jul. 12, 2011, IP.com Prior Art Database, 37 pages.
Pervan, Darko (Author)/Valinge Flooring Technology, Technical Disclosure entitled "VA068 Press Lock VFT," IP com No. IPCOM000208854D, Jul. 20, 2011, IP.com Prior Art Database, 25 pages.
Pervan, Darko (Author), Technical Disclosure entitled "V069 Combi Tongue," IP com No. IPCOM00210866D, Sep. 13, 2011, IP.com Prior Art Database, 41 pages.
Pervan, Darko (Author), Technical Disclosure entitled "VA070 Strip Part," IP com No. IPCOM0002108670, Sep. 13, 2011, IP.com Prior Art Database, 43 pages.
Pervan, Darko (Author), Technical Disclosure entitled "VA071 Pull Lock," IP com No. IPCOM0002108680, Sep. 13, 2011, IP.com Prior Art Database, 22 pages.
Pervan, Darko (Author), Technical Disclosure entitled "VA073a Zip Loc," IP com No. IPCOM000210869D, Sep. 13, 2011, IP.com Prior Art Database, 36 pages.
Complaint by Valinge Flooring Technology AB, Valinge Flooring Technology AB gegen Spanolux N.V. Divisie Balterio, Jan. 7, 2013, 144 pages, Grunecker Patent—und Rechtsanwalte, Munchen, DE (with machine translation of Complaint; and with Attacthments ("Anlage").
Court Order, Verfugung im Rechtsstreit Valinge Flooring Gegen Spanolux N.V., Jan. 9, 2013, 2 pages, Landgericht Mannheim, Mannheim, DE (With Human Translation).
Reply by Spanoiux N.V. Divisie Balterio, Valinge Flooring Technology AB gegen Spanolux N.V. Divisie Baiterio, Mar. 12, 2013, 669 pages, Bird & Bird LLP, Dusseldorf, DE (with machine translation of Reply; and with Attachments ("Anlage").
Reply by Valinge Flooring Technology AB, Valinge Flooring Technology AB gegen Spanolux N.V. Divisie Balterio, Jul. 3, 2013, 107 pages, Grunecker Patent—und Rechtsanwalte, Munchen, DE (with machine translation of Reply; and with attachments ("Anlage").
Repiy by Spanoiux N.V. Divisie Balterio, Vaiinge Flooring Technology AB gegen Spanoiux N.V. Oivisie Baiterio, Sep. 17, 2013, 832 pages, Bird & Bird LLP, Dlisseldorf, DE (with machine translation of Reply; and with Attac 1ments ("Analage").
Reply by Valinge Flooring Technology AB, Valinge Flooring Technology AB gegen Spanolux N.V. Divisie Balerio, Sep. 23, 2013, 41 pages, Grunecker Patent—und Rechtsanwalte, Munchen, DE (with machine transiation of Reply).

* cited by examiner 9
1
11
32
30
29
22
24
19
5
41
21
40
9
2
10
38
31
33
37
36
25
28
34
20
35
39
6
12
10
35
34
26
S
19
26
25

5
2
24
1
10
28
5
37
25
6
S
α

9
2
10
12
34
21
35
42
19
5
24
28
25
30
36
32
33
11
6
1
32
9
31
S
42

SET OF MUTUALLY LOCKABLE PANELS

CROSS-REFERENCE TO RELATED APPLICATION

The present application is a continuation of and claims priority of U.S. patent application Ser. No. 16/821,634 which is a continuation of U.S. patent application Ser. No. 16/404,329, filed May 6, 2019, now U.S. Pat. No. 10,612,250, which is a continuation of and claims priority of U.S. patent application Ser. No. 15/128,078, filed Sep. 21, 2016, now U.S. Pat. No. 10,280,627, which is a national stage of international patent application no. PCT/EP2015/056297, filed Mar. 24, 2015 and published as WO 2015/144726, and where U.S. patent application Ser. No. 15/128,078 is also a continuation of and claims priority of U.S. patent application Ser. No. 14/223,303, filed Mar. 24, 2014, now U.S. Pat. No. 9,260,870, the contents of which each is hereby incorporated by reference in their entirety.

BACKGROUND

The discussion below is merely provided for general background information and is not intended to be used as an aid in determining the scope of the claimed subject matter.

Aspects of the invention relate to a set of mutually lockable panels, such as floor, wall or ceiling panels, comprising a first panel having a front face, a back face and an edge including a male part which is directed in a direction from its front face to its back face, a second panel having a front face, a back face and an edge including a female part for receiving the male part of the first panel in unlocked condition of the panels, wherein the male part has an outer side which, in locked condition of the panels, is directed to the second panel in a direction substantially parallel to the front face of the first panel, and an opposite inner side which is provided with a locking surface, wherein the female part comprises a locking member, which is pivotable about a pivot axis that extends substantially parallel to the edge of the second panel, wherein the locking member has a stop surface remote from the pivot axis, which stop surface cooperates with the locking surface of the male part in locked condition of the panels so as to lock the panels with respect to each other at least in a direction substantially perpendicular to the locking surface and the stop surface, wherein the second panel is provided with an actuator for rotating the locking member from its first position in unlocked condition of the panels to a second position in locked condition of the panels in which the locking surface and the stop surface cooperate.

A set of panels having a locking member for locking the panels with respect to each other in a direction perpendicular to the locking surface and the stop surface is known, for example from WO 2011/085825. The known locking member is a separate part and requires high production accuracy of the panels and the locking members to create the same characteristics of movement of all the locking members during locking actions.

SUMMARY

This Summary and the Abstract herein are provided to introduce a selection of concepts in a simplified form that are further described below in the Detailed Description. This Summary and the Abstract are not intended to identify key features or essential features of the claimed subject matter, nor are they intended to be used as an aid in determining the scope of the claimed subject matter. The claimed subject matter is not limited to implementations that solve any or all disadvantages noted in the Background.

An aspect of the invention is to provide a set of panels including a simple locking mechanism.

According to the disclosure the pivot axis has a substantially fixed position with respect to the second panel. This allows a precise displacement of the control member during a locking action, since the pivot axis remains at a substantially predetermined position with respect to the second panel.

In an advantageous embodiment the locking member is formed integral with the second panel, since this simplifies a manufacturing process of the set of panels compared to applying a separate locking member. Nevertheless, it is still possible to apply the locking member as a separate part.

The locking member may cause a resistance requiring a minimum predefined force for rotating the locking member from its first position in unlocked condition of the panels. This provides the opportunity of a controlled locking action and prevents the locking member from rotating upon handling the second panel before the locking action is intended.

In a practical embodiment the locking member is pivotable by means of a living hinge. Typically in case of a set of LVT panels or alternative flexible panels such a living hinge can be made of the material of the second panel itself.

In an advantageous embodiment the living hinge is formed by a slit in the second panel, since this can be performed relatively simply in a manufacturing process. The slit may be applied in the back face of the second panel, but in an alternative embodiment the slit is applied in the female part opposite to the back face of the second panel, as long as the slit supports to facilitating the movement of the locking member to its second position.

At least the second panel may be provided with a reinforcement portion at the living hinge in order to reinforce the living hinge and to avoid any weak portion or even cracks at that location during and after a locking action. The reinforcement portion may comprise a layer of reinforcing material which is incorporated in the second panel or applied at its back face.

Alternatively, the set of mutually lockable panels, such as floor, wall or ceiling panels, comprises a first panel having a front face, a back face and an edge including a male part which is directed in a direction from its front face to its back face, a second panel having a front face, a back face and an edge including a female part for receiving the male part of the first panel in unlocked condition of the panels, wherein the male part has an outer side which, in locked condition of the panels, is directed to the second panel in a direction substantially parallel to the front face of the first panel, and an opposite inner side which is provided with a locking surface, wherein the female part comprises a locking member and a bendable portion for moving the locking member with respect to the rest of the second panel by bending the bendable portion, wherein the locking member has a stop surface, which cooperates with the locking surface of the male part in locked condition of the panels so as to lock the panels with respect to each other at least in a direction substantially perpendicular to the locking surface and the stop surface, wherein the second panel is provided with an actuator for displacing the locking member from its first position in unlocked condition of the panels to a second position in locked condition of the panels in which the locking surface and the stop surface cooperate, wherein the bendable portion is bendable with respect to a bending axis that extends substantially parallel to the edge of the second panel, wherein the locking member and the bendable portion are formed integral with the second panel. An advantage of this set of panels is that a step of assembling the second panel and the locking member can be omitted. The locking member is remote from the bending axis, but will not rotate about the bending axis like in case of a pivot axis, even if the bending axis has a fixed position with respect to the second panel.

In a practical embodiment, in the locked condition of the panels, the locking surface is directed to the front face of the first panel and the stop surface is directed to the back surface of the second panel so as to lock the panels with respect to each other at least in a direction substantially perpendicular to their front faces.

In a particular embodiment the actuator has a control surface which is directed away from the back face of the second panel and which is displaceable with respect to the back face of the second panel in a direction from its back face to its front face so as to move the locking member. This means that the actuator can be activated through the control surface at the back face of the second panel. For example, the control surface may abut a basis to which the second panel is placed, whereas a reaction force can be exerted onto the control surface upon pressing the second panel against the basis so as to move the locking member.

The actuator may be located at the locking member, which provides the opportunity to omit any transmission between the actuator and the locking member.

The back face of the second panel may have a contact surface for supporting the second panel on a basis, wherein the control surface projects from the contact surface in unlocked condition of the panels.

The actuator may be a protrusion, which is formed from a cured liquid, for example. This is relatively simple to manufacture. For example, a curable liquid can be printed and cured on the back face of the second panel at the locking member. Alternative manners of applying a protrusion are conceivable, for example by means of extrusion of a material, or applying a curable material by means of a valve jet, or during pressing the panels, or during laminating the panels, or the like. It is also possible to create a ridge by means of removing material adjacent to the intended protrusion. Furthermore, in case of applying a reinforcement portion at the living hinge as mentioned above, the reinforcement portion may be applied in the same manner as the actuator and even form a single piece with the actuator after curing, for example as a reinforcement layer. In the latter case the dimensions of the actuator and the reinforcement layer may be different in order to create their different functions.

The actuator may be more rigid or less flexible than the rest of the second panel. A relatively rigid actuator is advantageous in case of laying the set of panels as floor panels on a relatively soft subfloor. The subfloor can be locally deformed by the actuator during a locking action and transfer a force to move the locking member from its first position to its second position upon pressing the second panel onto the subfloor. This is advantageous with respect to conventional locking systems that are on the market. Adjacent panels on a soft subfloor including an actuator in the form of a rigid strip provide a relatively high load capacity and back pressure on the locking member in order to keep the locking member at place, comparable to a ski in the snow. In case of a more flexible material of the actuator it might be self-releasing unintentionally.

In an advantageous embodiment in the locked condition the stop surface is inclined with respect to the front face of the second panel in a direction from its back face to its front face as seen in a direction from the first panel to the second panel, since this also enables a lock in a direction substantially perpendicular to the edges and substantially parallel to the front faces of the panels. This embodiment appears to be surprisingly advantageous in case of a set of flexible panels, which are laid as floor panels on a relatively soft subfloor. Due to a local load close to the edges of the first and second panels the subfloor may deform such that the female part is not or slightly supported. The orientation of the stop surface causes that the male part and the female part to remain in joined condition. If the stop surface in the locked condition extended perpendicularly to the front face of the second panel the risk of de-coupling would be greater under such a load.

It is noted that the orientation of the stop surface of the female part is changed between the first position and the second position of the locking member either by pivoting the locking member or by moving the locking member by means of bending the bendable portion. This means that after manufacturing the female part of the second panel the angle between the stop surface and the back face of the second panel, is larger than it will be in the locked position. Particularly in case of machining the female part, when it is integral with the second panel, this simplifies the method of manufacturing since machining such as milling becomes more difficult with decreasing angle between the stop surface and the back face of the second panel because of required space for tools. Nevertheless, the panels may also be made via a process of extrusion.

In a further embodiment the outer side of the male part and an edge portion of the second panel which is opposite thereto in locked condition of the panels may be provided with a snap fastener for mutually locking them in a direction substantially perpendicular to the front faces of the panels. This is an extra lock between the panels in the mentioned direction in addition to the locking member and guarantees locking in a direction substantially perpendicular to the upper faces of the panels in addition to the locking member.

In a particular embodiment the male part has a lower surface directed in a direction from the front face to the back face of the first panel and the female part has a bottom surface directed in a direction from the back face to the front face of the second panel, wherein the lower surface contacts the bottom surface in an interengaged but still unlocked condition of the panels. This means that upon assembly of the set of panels the female part receives the male part until the lower surface of the male part abuts the bottom surface of the female part, after which the actuator of the locking member can be activated for moving the locking member to a position in which the set of panels are locked to each other. For example, in case the control surface of the actuator protrudes from the contact surface of the second panel and the set of panels are placed in the interengaged condition on a substantially flat basis the control surface contacts the basis whereas the contact surface of the second panel does not or only partly contact the basis at a distance from the control surface of the actuator. Upon pressing the male part on the bottom surface of the female part towards the basis the actuator will exert a force on the locking member in opposite direction, hence rotating the locking member or moving the locking member by means of bending the bendable portion. An advantage of this embodiment is that the female part may start to engage the male part when the panels are already almost in their final mutual position instead of pressing a male part into a clamping female part over a relatively long distance such as in well-known prior art locking mechanisms. The lower surface and the bottom surface may also contact each other in locked condition of the panels. It is, however, conceivable that the panels are flexible such that the lower surface of the male part contacts the bottom surface of the female part during the locking action but they are free from each other in the locked condition. Nevertheless, in practice the lower surface and the bottom surface may contact each other partly or entirely during and after the locking action.

In order to keep the locking member in a fixed position with respect to the panels in locked condition thereof the locking member may have a holding element, which is remote from the control surface of the actuator. The holding element and the first panel may comprise a snap fastener for snapping them to each other. Alternatively, such a holding element may be omitted if the locking member maintains its position in the locked condition automatically, for example if the second panel keeps the control surface of the actuator fixed to the basis onto which it is placed.

In case of light-weight floor panels and/or a locking member which remains biased in locked condition the presence of the holding element may be desired in order to prevent the locking member from moving back, hence automatic de-locking.

The locking member may be dimensioned such that in locked condition a free end of the locking member remote from the actuator and directed in a direction from the back face to the front face of the second panel is free from the first panel. Alternatively, the free end of the locking member does contact the first panel in the locked condition. In general, the free end of the locking member may contact the first panel partly or entirely and/or the lower surface and the bottom surface may contact each other partly or entirely in the locked condition.

In a particular embodiment the male part comprises a longitudinal tongue extending along the edge of the first panel and the female part comprises a cooperating groove extending along the edge of the second panel, wherein at least a part of the locking member forms a side wall of the groove. In this case the edges of the panels form hooked profiles which can be machined in a wellknown manner.

The inner side of the male part may be provided with a recess, wherein the locking surface is part of the recess. The male part and the female part may be dimensioned such that in locked condition of the panels the locking member presses the outer side of the male part against the second panel in order to obtain a proper seal at a seam between the first and second panel.

In an advantageous embodiment each of the panels has a first edge including the male part and an opposite second edge including the female part, since this provides the opportunity to create a surface covering from a plurality of such panels, since each panel has similar pairs of opposite edges which can be mutually locked.

In a further embodiment the panels are rectangular and two remaining opposite edges of each panel have a tongue and a groove, respectively, which are configured to couple similar panels along said edges by means of angling in. It is also conceivable that the remaining opposite edges of each panel include the male part and the female part, as well, such that the panels can be joined by means of a displacement substantially perpendicular to the front faces of the panels.

The panels may be made of a flexible or rigid material, for example LVT (Luxury Vinyl Tile), MDF/HDF, mineral materials, a wood plastic composite (WPC) or other composites including plastics. Alternatively, the panels may be made of a combination of flexible and rigid materials. For example, the male part and/or female part may be partly or entirely made of a material which is more flexible than the remainder of the panels. Panels having regions of different materials can be made by means of coextrusion, for example.

The invention is also related to a set of mutually lockable panels, such as floor, wall or ceiling panels, comprising a first panel having a front face, a back face and an edge including a male part which is directed in a direction from its front face to its back face, a second panel having a front face, a back face and an edge including a female part for receiving the male part of the first panel in unlocked condition of the panels, wherein the male part has an outer side which, in locked condition of the panels, is directed to the second panel in a direction substantially parallel to the front face of the first panel, and an opposite inner side which is provided with a locking surface, wherein the female part comprises a locking member, which is pivotable about a pivot axis that extends substantially parallel to the edge of the second panel wherein the locking member has a stop surface remote from the pivot axis, or wherein the female part comprises a locking member and a bendable portion for moving the locking member with respect to the rest of the second panel by bending the bendable portion, wherein the locking member has a stop surface, which stop surface cooperates with the locking surface of the male part in locked condition of the panels so as to lock the panels with respect to each other at least in a direction substantially perpendicular to the locking surface and the stop surface, wherein the second panel is provided with an actuator for rotating the locking member from its first position in unlocked condition of the panels to a second position in locked condition of the panels in which the locking surface and the stop surface cooperate, wherein the actuator has a control surface which is directed away from the back face of the second panel and which is displaceable with respect to the back face of the second panel in a direction from its back face to its front face so as to move the locking member. An advantage of this set of panels is that the locking member can be moved from its first position to its second position by moving the second panel to a supporting basis whereas the supporting basis moves the control surface, and thus the locking member, in opposite direction. It is noted that other characteristics as described hereinbefore can be combined with this set of panels.

The disclosure is also related to a set of mutually lockable panels, such as floor, wall or ceiling panels, comprising a first panel having a front face, a back face and an edge including a male part which is directed in a direction from its front face to its back face, a second panel having a front face, a back face and an edge including a female part for receiving the male part of the first panel in unlocked condition of the panels, wherein the male part has an outer side which, in locked condition of the panels, is directed to the second panel in a direction substantially parallel to the front face of the first panel, and an opposite inner side which is provided with a locking surface, wherein the female part comprises a locking member and a bendable portion for moving the locking member with respect to the rest of the second panel by bending the bendable portion, wherein the locking member has a stop surface, which cooperates with the locking surface of the male part in locked condition of the panels so as to lock the panels with respect to each other at least in a direction substantially perpendicular to the locking surface and the stop surface, wherein the second panel is provided with an actuator for displacing the locking member from its first position in unlocked condition of the panels to a second position in locked condition of the panels in which the locking surface and the stop surface cooperate, wherein the bendable portion is bendable with respect to a bending axis that extends substantially parallel to the edge of the second panel, wherein in the locked condition the bendable portion is bent about a bending center at a distance from the bendable portion at a distance from the bendable portion. An advantage of this set of panels is that local stress in the bendable part is relatively low. The bending center may be located at a distance from the front face as seen in a direction from the back face to the front face of the second panel. In that case the bending axis may be located at a fixed position where the flexible lip transfers into the rest of the panel.

In a particular embodiment the male part has a lower surface directed in a direction from the front face to the back face of the first panel and the female part has a bottom surface directed in a direction from the back face to the front face of the second panel, wherein the bottom surface is part of the bendable portion. In practice the bendable portion may be a flexible lip which extends between the locking member and the rest of the second panel.

When the lower surface contacts the bottom surface in an interengaged but still unlocked condition of the panels the bendable portion may at least partly bend about the lower surface of the male part. This is further simplified if the lower surface is at least partly curved about the bending center, whereas the bottom surface is substantially flat in the unlocked condition. In order to prevent the locking member from automatic delocking, the locking member may have a holding element for holding the locking member in a fixed position with respect to the panels in locked condition thereof. It is noted that other features as described hereinbefore can be combined with this set of panels.

BRIEF DESCRIPTION OF THE DRAWINGS

The invention will hereafter be elucidated with reference to the schematic drawings showing embodiments of the invention by way of example.

DETAILED DESCRIPTION OF THE ILLUSTRATIVE EMBODIMENTS

Figure 1:
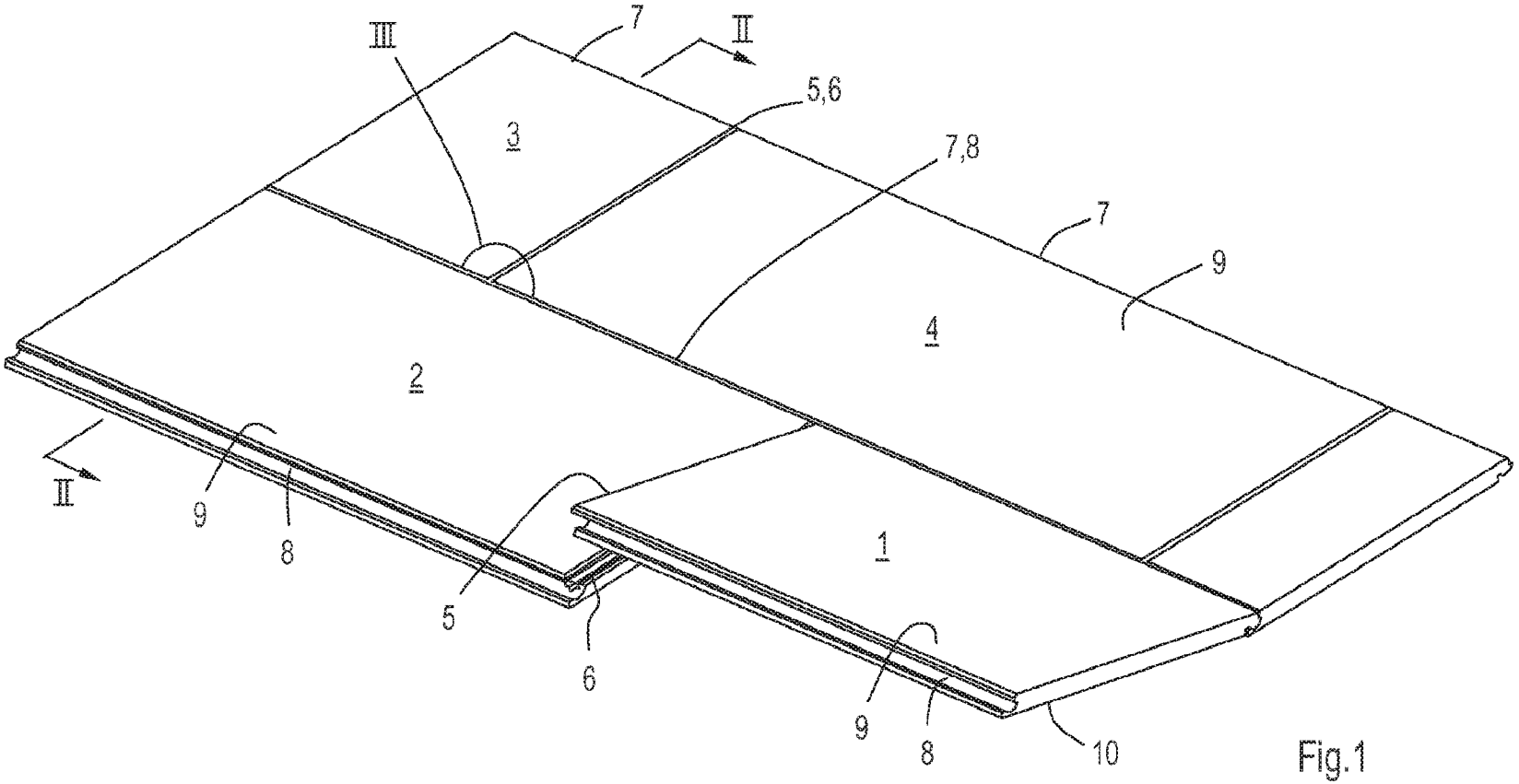
FIG. 1 is a perspective view of a plurality of panels including an embodiment of a set of panels according to the invention in a stage of laying the panels.

FIG. 1 shows a number of panels including an embodiment of a set of panels according to the invention. FIG. 1 shows a first panel 1, a second panel 2, a third panel 3 and a fourth panel 4. These panels are substantially rectangular and may both be square or elongated. The four panels 1-4 shown are elongated having a first edge 5 and an opposite second edge 6 that are the short edges, and a third edge 7 and an opposite fourth edge 8 that form the long edges.

In principle the set of panels is intended to form a floor covering, but the panels may also be used as wall panels, ceiling panels or panels for covering other surfaces. These surfaces may be indoor or outdoor surfaces.

The panels according to the embodiment as shown in the figures are made of LVT (Luxury Vinyl Tile), which is a flexible material. In an alternative embodiment, the panels may be constructed as laminate panels for forming a laminate flooring which is well-known in the art. These panels are used to imitate planks or tiles of natural material, such as wood, stone or any other material. Generally these laminate panels comprise a core of relatively cheap material, in particular a wood based material such as material including wood particles or fibres such as MDF/HDF, mineral materials, a wood plastic composite (WPC) or other composites including plastics. The core of these panels is covered by a decorative layer formed for example from transfer foil or a laminate of resin impregnated paper layers. The decor may also be formed in a different way, for example by printing directly and/or digitally on the core, or by finishing the core by embossing, chafing or the like. The panels may also be made of wood, plastic or other material with or without separate upper and/or lower layers.

Each of the four panels 1-4 has a front face 9 and a back face 10. The edges 5-8 of each panel 1-4 are adapted to lock the panels to each other to obtain a floor covering in which the panels are coupled to each other substantially without the formation of a gap. For this purpose, the first edge 5 of each panel is provided with a male part 11 which is directed in a direction from its front face 9 to its back face 10, and the second edge 6 is provided with a female part 12 for receiving the male part 11 in unlocked condition of the panels, whereas the third edge 7 is provided with a male joining member 13 and the fourth edge 8 with a female joining member 14, see FIGS. 2-4.

Figure 2:
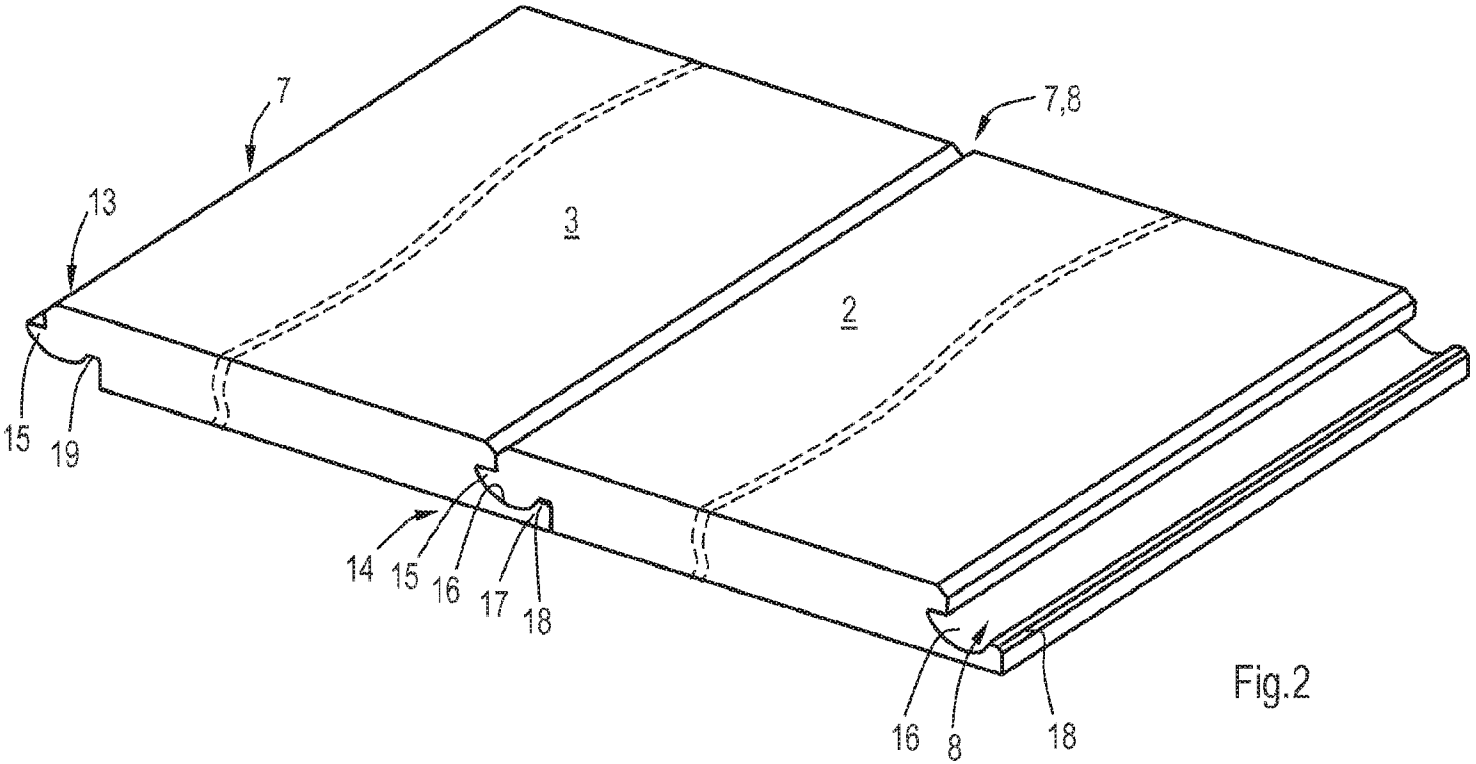
FIG. 2 is an enlarged cross sectional view according to the line II-II in FIG. 1 showing partly two panels with their third and fourth edges on the long sides of the panels.

The third and fourth edges 7, 8 with the male and female joining members 13, 14 are shown in FIG. 2 and may be configured in a well-known manner. These joining members 13, 14 are such that they allow a joining of the third and fourth edges 7, 8 of two panels by bringing the male joining member 13 in contact with the female joining member 14 of a panel or of two panels which are already installed on the surface. In FIG. 1, panel 1 is brought in engagement with panels 2 en 4. The male joining member 13 is brought in engagement with the female joining member 14 while the panel 1 is held in a relatively inclined position, whereafter panel 1 with the male joining member 13 is rotated with respect to the other panels 2 and 4 so as to bring the front faces 9 of the panels 1-4 substantially in alignment with each other. This method is also known as the "angling in" joining method. In principle, it would also be possible to angle in a female joining member onto a male joining member of a panel already installed.

In the embodiment shown in FIG. 2 the joining members comprise locking means which prevent the panels from drifting apart in a direction substantially parallel to their front and back faces 9, 10 and substantially perpendicularly to their edges 7, 8. These locking means are configured such that they exert a force urging the panels towards each other (i.e. substantially perpendicular to their edges) while the panels are in their joined condition. This force counteracts the formation of gaps between the panels, in particular at the position near the front face 9 where the panels meet each other. This position may be exactly at the front faces 9, but in case the upper borders of the panels are machined for example to form a V-groove, see FIGS. 1-3, U-groove or other lowered area between the panels, the panel edges will meet at a distance from the front faces 9. It is also conceivable that the locking means are configured such that they meet each other at the front faces 9 or at a distance thereof without forcing the panels to each other.

FIG. 2 also shows that the male joining member 13 includes a tongue 15, while the female joining member 14 includes a groove 16 which is able to receive at least a portion of the tongue 15 therein so as to lock the panels with respect to each other in a direction substantially perpendicularly to the front and back faces 9, 10, i.e. in vertical direction. The shape of the tongue and groove 14, 15 may have all kinds of configurations and orientations as long as they include surfaces that restrict movements in a direction substantially perpendicularly to the front and back faces 9, 10.

The horizontal lock of the panels away from each other is accomplished by means of a lip 17 below the groove 16 projecting from the panel 3 and carrying near its free edge an upper protrusion 18 engaging into a lower groove positioned behind the tongue 15 of the panel 2.

Figure 3:
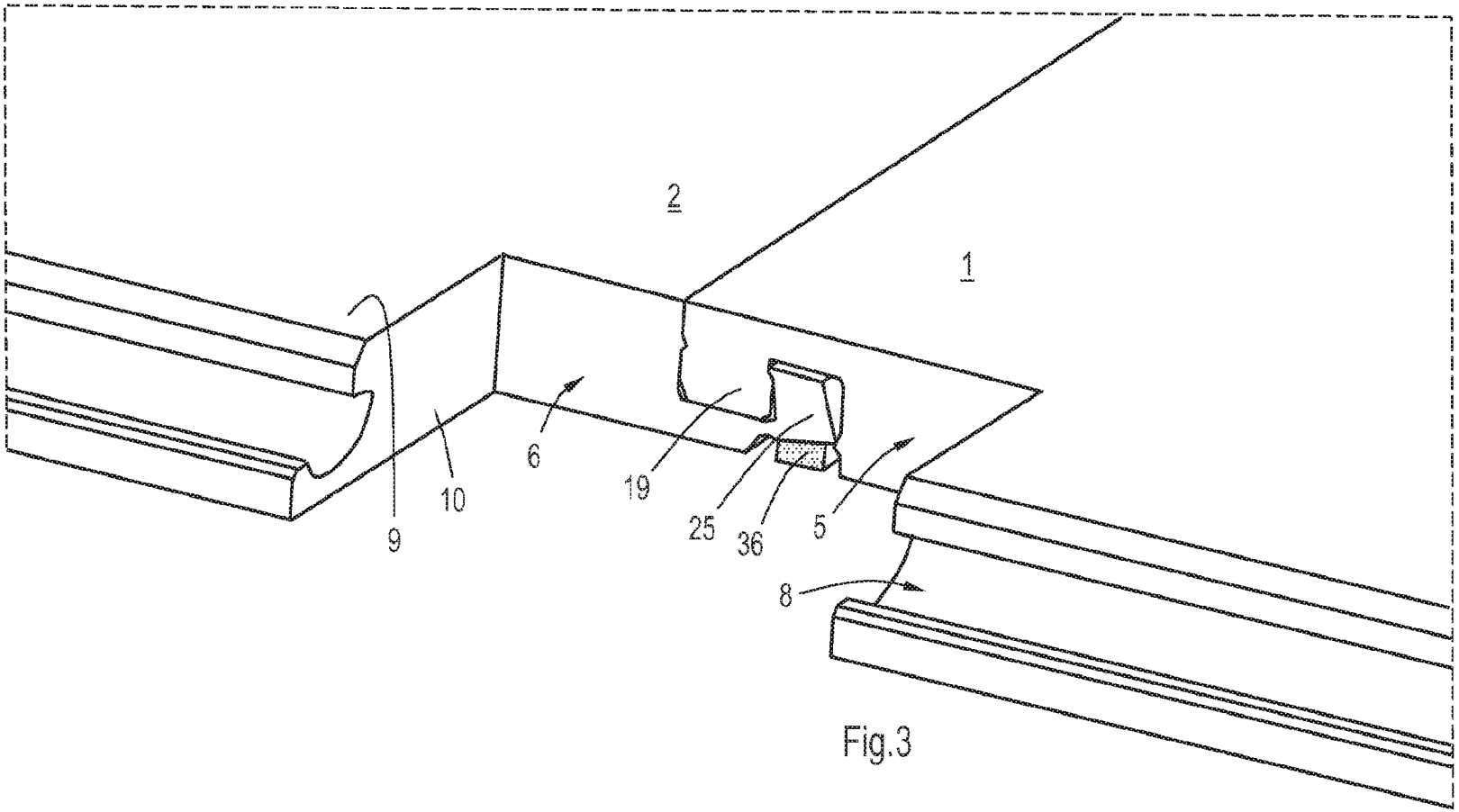
FIG. 3 is a perspective view of a partly cut-away detail III in FIG. 1 showing the joined edges on the short side of two panels of FIG. 1.
Figure 4:
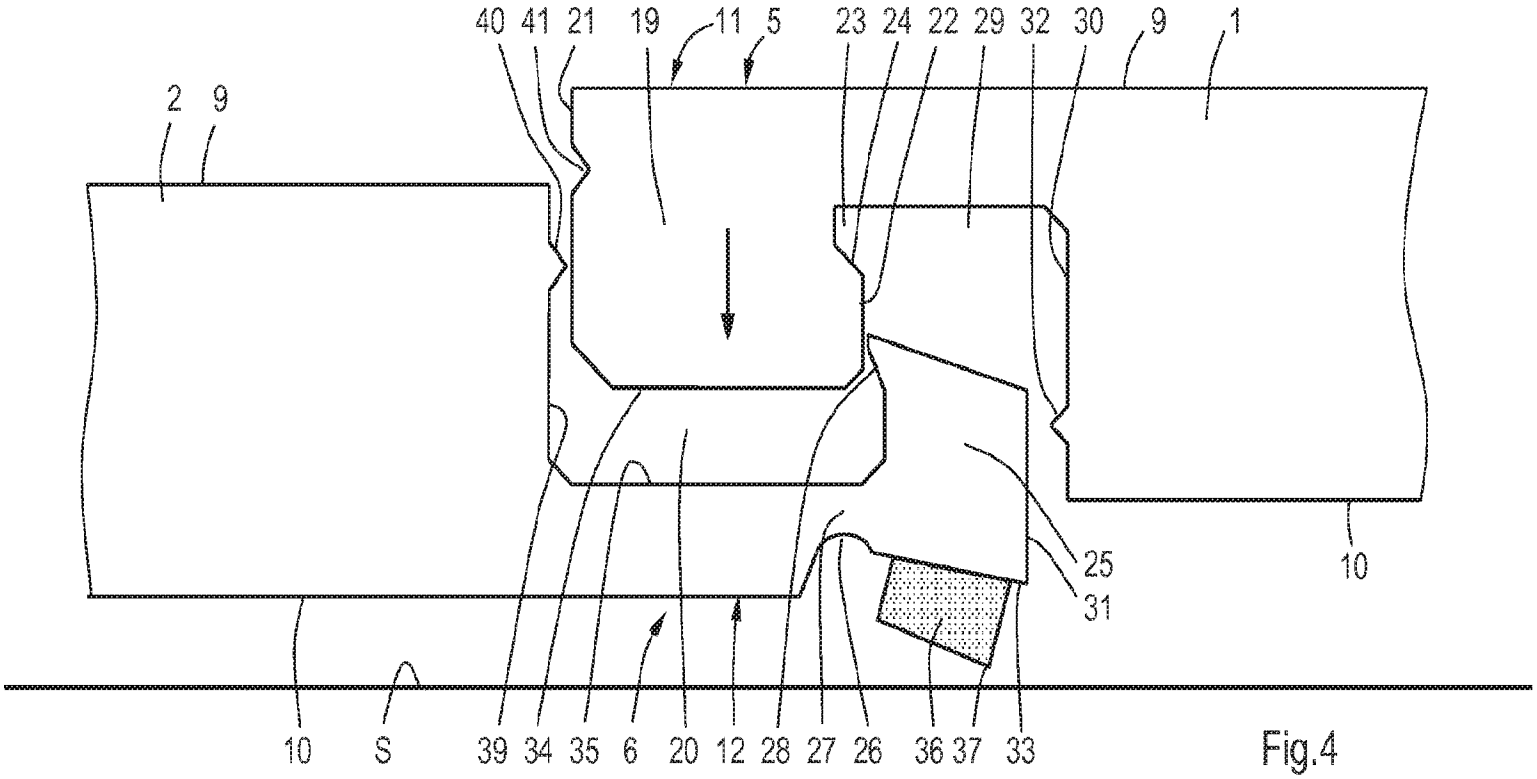
FIGS. 4-6 are enlarged cross-sectional views of the subject of FIG. 3, in three different positions illustrating the unlocked and locked condition of the panels.
Figure 5:
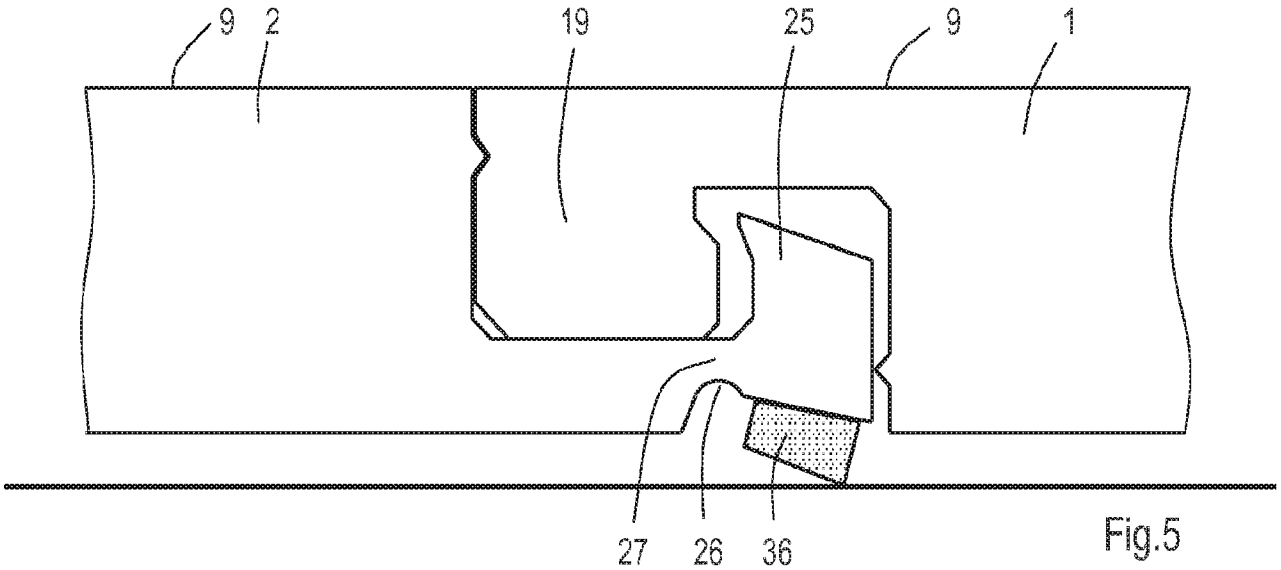
Figure 6:
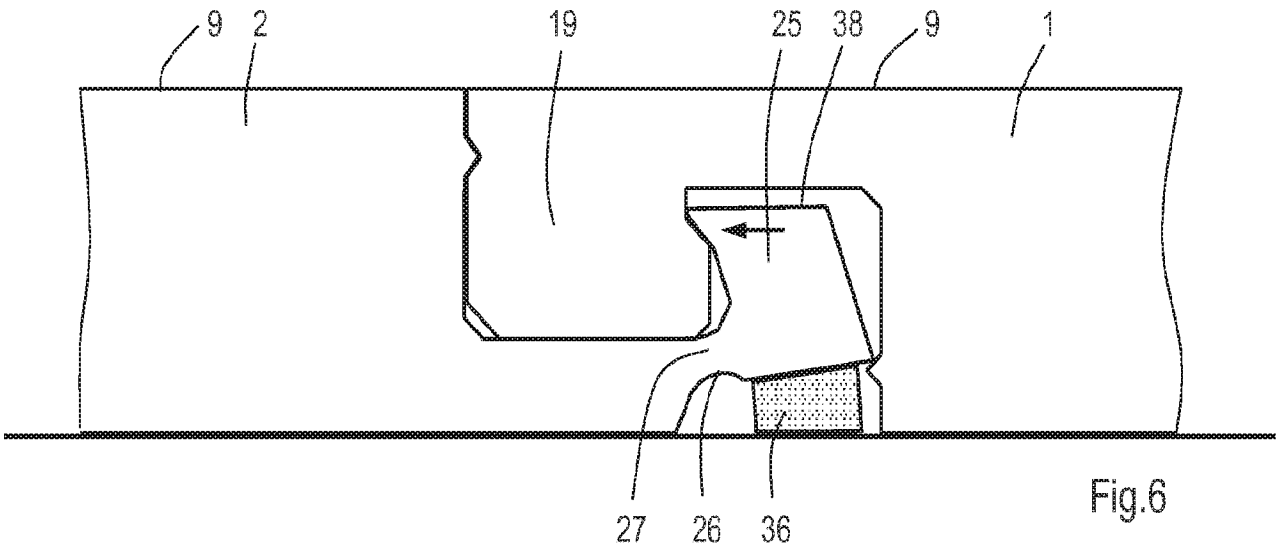

FIGS. 3-6 show the first and second edges 5, 6 of the first and second panels 1, 2 with the male part 11 and the female part 12, respectively, enabling the panels to be locked to each other. It is shown in the drawings that the male part 11 comprises a longitudinal tongue 19 extending along the first edge 5 of the first panel 1 and the female part 12 comprises a cooperating groove 20 extending along the second edge 6 of the second panel 2. FIGS. 3 and 6 show the panels 1, 2 in locked condition.

The tongue 19 has an outer side 21 which, in locked condition of the first and second panels 1, 2, is directed in a direction from the first panel 1 to the second panel 2 in a direction substantially parallel to the front faces 9 of the panels, as shown in FIG. 6. The tongue 19 comprises an inner side 22 which extends opposite to its outer side 21. The inner side 22 has an undercut or recess 23 including a locking surface 24 which is directed to the front face 9 of the first panel 1. In the embodiment as shown in FIGS. 1-6 the locking surface 24 is inclined with respect to the front face 9 of the first panel 1 in a direction from its front face 9 to its back face 10, i.e. downwardly in this case, as seen from the outer side 21 of the tongue 19.

In unlocked condition of the first and second panels 1, 2 the groove 20 of the female part 12 is suitable to receive the tongue 19 of the first panel 1. This is illustrated in FIG. 4 by an arrow directed downwardly, indicating that the first panel 1 is moved downwardly with respect to the second panel 2 such that the tongue 19 enters into the groove 20. Hence, the width of the groove 20 is sufficient to let the tongue 19 pass downwardly.

The female part 12 comprises a locking member 25. FIGS. 4-6 show that the locking member 25 is formed integral with the second panel 2. In an alternative embodiment it may be a separate element. The locking member 25 forms a side wall of the groove 20 and is pivotable about a pivot axis which extends substantially parallel to the second edge 6 of the second panel 2. FIG. 4 shows that the back face 10 of the second panel 2 is provided with a recess 26 which extends along the second edge 6 and forms a living hinge 27 including the pivot axis. This means that the pivot axis has a substantially fixed position with respect to the second panel 2. Due to the presence of the living hinge 27, the locking member 25 is pivotable about the pivot axis. In order to avoid the locking member 25 from premature rotation the locking member 25 causes a resistance requiring a minimum predefined force for rotating the locking member 25 from its first position in unlocked condition of the panels 1, 2, i.e the condition as shown in FIGS. 4 and 5. The resistance may be overcome by creating a minor crack in the second panel 2 close to the intended pivot axis, for example.

It is noted that the locking member 25 is to couple the first and second edges 5, 6 to each other such that it locks the first and second panels 1, 2 to each other in both a direction substantially perpendicular to the upper surface 9 and in a direction substantially parallel to the upper surface 9 but substantially perpendicular to the adjacent first and second edges 5, 6 in their locked condition, as shown in FIG. 6.

The locking member 25 has a stop surface 28 which extends substantially parallel to the pivot axis but remote therefrom. The stop surface 28 is directed to the back face 10 of the second panel 2, in this case directed downwardly, and cooperates with the locking surface 24 of the male part 11 in locked condition of the first and second panel 1, 2 as shown in FIG. 6. In this condition the first panel 1 is prevented from displacement upwardly with respect to the second panel 2, and also prevented from displacement in a direction away from the second panel 2 in horizontal direction. In locked condition of the panels 1 and 2 their respective front faces 9 are substantially flush in the embodiment as shown in FIG. 6.

Upon moving the tongue 19 of the first panel 1 into the groove 20 of the second panel 2 the locking member 25 is received by a groove 29 in the first panel 1, located between the inner side 22 of the tongue 19 and an opposite groove wall 30. When the locking member 25 moves into the groove 29 of the first panel 1 the groove wall 30 faces an outer side 31 of the locking member 25, see FIG. 4. The outer side 31 of the locking member 25 forms a distal end of the second edge 6 of the second panel 2, facing away from the second panel 2. In the locked condition the locking member 25 is maintained in a fixed position with respect to the first and second panel 1, 2 by a holding element in the form of a snap fastener, in this case a protrusion 32 on the groove wall 30 that fits behind a corner 33 at the outer side 31 of the locking member 25. This may also be a recess in the outer side 31 of the locking member 25 in an alternative embodiment.

The tongue 19 of the male part 11 has a lower surface 34 which is directed downwardly and the female part 12 has a bottom surface 35 at the groove 20 which is directed upwardly. The locking member 25 extends beyond the bottom surface 35 as seen in a direction from the back face 10 to the front face 9 of the second panel 2. In locked condition the lower surface 34 contacts the bottom surface 35. The profiles of the first and second edges 5, 6 of the respective first and second panel 1, 2 are dimensioned such that when the first panel 1 is moved downwardly during assembly the lower surface 34 of the tongue 19 contacts the bottom surface 35 in the groove 20 before the locking member 25 has rotated with respect to the remainder of the second panel 2. This means that the lower surface 34 contacts the bottom surface 35 in an interengaged but still unlocked condition of the panels 1, 2. This intermediate condition is illustrated in FIG. 5. In this condition the first and second panel 1, 2 are already almost in their final positions, but still unlocked. From that condition the locking member 25 can be rotated upwardly in order to achieve the locked condition of the panels 1, 2 as illustrated in FIG. 6. The width of the contact surface between the lower surface 34 and the bottom surface 35 as shown in FIGS. 5-6, extending in a direction substantially parallel to the upper faces 9 and substantially perpendicularly to the first and second edges 5, 6, may be smaller in practice.

At the back face 10 of the second panel 2 the locking member 25 is provided with an actuator 36 for rotating the locking member 11 to a position in which the panels 1, 2 are locked with respect to each other. As shown in FIG. 4 the actuator 36 has a control surface 37 which is directed downwardly and which is displaceable upwardly with respect to the back face 10 of the second panel 2 as illustrated in FIG. 6. In the embodiment as shown in FIGS. 4-6 the back face 10 of the second panel 2 has a substantially flat contact surface which is intended to be supported by the basis S and the control surface 37 of the actuator 36 extends below the contact surface in unlocked condition of the panels 1, 2. This means that the locking member 25 can be rotated about the pivot axis by means of pressing the second panel 2 to the basis S. As shown in FIG. 6 the locking member 25 is rotated such that a protruding portion of the locking member 25 including the stop surface 28 is moved into the recess 23 of the tongue 19.

It is noted that in the condition as shown in FIGS. 4 and 5 the first and second panel 1, 2 are both angled with respect to the third and fourth panel 3, 4, which is different with the situation as shown in FIG. 1. The first and second panel 1, 2 are aligned and angled downwardly together towards the locked condition. Hence, during the locking action the panels 1, 2 are angled-in and locked simultaneously. The situation as illustrated in FIG. 1 is also possible, but in that case the second panel 2 will contact the basis S at the control surface 37 of the actuator 36 as well as at its back face 10 at its second edge 6, hence slightly tilted. When the panels 1, 2 are flexible and they are interengaged but still not locked to each other, it is possible to press at first a portion of the first edge 5 of the first panel 1 closest to the third edge 7 downwardly such that the locking member 25 starts to rotate whereas the locking member 25 at an adjacent portion starts to rotate when the press force is shifted along the first edge 5 towards the fourth edge 8 of the first panel 1. Hence, the locking member 25 will be pivoted gradually along the first edge 5 upon assembly.

The locking member 25 of the embodiment as shown in FIGS. 1-6 has a C-shaped cross section, wherein one end portion of the C is located at the living hinge 27 and the opposite end portion of the C comprises the stop surface 28. In an alternative embodiment the locking member may have a stop surface that in unlocked condition of the panels extends substantially perpendicularly to the front face 9 of the second panel 2 or is even directed to its front face as seen from the outer side 31 of the locking member 25, but will be directed to the back face of the second panel in locked condition of the panels 1, 2, due to pivoting.

The actuator 36 can be made by printing a strip of a curable liquid on the back face 10 of the second panel 2 at the location of the locking member 25. The recess 26 can be made by cutting a slit in the back face 10 of the second panel 2. Numerous alternative methods of creating the recess 26 and/or the actuator 36 are conceivable.

As mentioned above, FIG. 5 shows an intermediate condition in which the tongue 19 is already received in the groove 20, but before the locking action has been performed. As shown in FIG. 5, before locking, the distance between the contact surface of the second panel 2 and the basis S is larger than the distance between the control surface 37 of the actuator 36 and the basis S. More specifically, the control surface 37 contacts the basis S, whereas the contact surface of the second panel 2 next to the control surface 37 is still free from the basis S. Upon pressing the tongue 19 of the first panel 1 onto the bottom surface 35 of the second panel 2 a reaction force will be exerted onto the actuator 36 in upward direction. Consequently, a torque will be exerted on the locking member 25 about the pivot axis. Above a predefined pressure of the tongue 19 onto the bottom surface 35 the resistance at the living hinge 27 will be overcome and the locking member 25 will be rotated as indicated by the arrow in FIG. 6.

FIG. 6 shows that in locked condition of the panels 1, 2 a free end 38 of the locking member 25 which is located at a distance from the actuator 36 and directed in a direction from the back face 10 to the front face 9 of the second panel 2 is free from the first panel 1.

In the locked condition of the panels 1, 2 the outer side 21 of the tongue 19 abuts against an opposite frontal edge portion 39 of the second panel 2. The frontal edge portion 39 is provided with a protrusion 40 that fits in a recess 41 in the outer side 21 of the tongue 19. When the set of panels 1, 2 are assembled the protrusion 40 snaps into the recess 41 such that an additional locking in vertical direction is created.

Referring to FIG. 1, it is noted that during angling-in of the first panel 1 the tongue 19 of the male part 11 is moved into the groove 20 of the female part 11, whereas the locking action can be performed when the lower surface 34 of the tongue 19 entirely or almost entirely contacts the bottom surface 35 of the groove 20.

In the intermediate condition as shown in FIG. 5, the outer side 21 of the tongue 19 contacts the frontal edge portion 39 of the second panel 2. Consequently, during the locking action a horizontal force to displace the first panel 1 to the second panel 2 can be omitted. It is, however, possible that the outer side 21 of the tongue 19 and the frontal edge portion 39 of the second panel 2 are still remote from each other in the intermediate condition.

Figures 7, 8, 9:
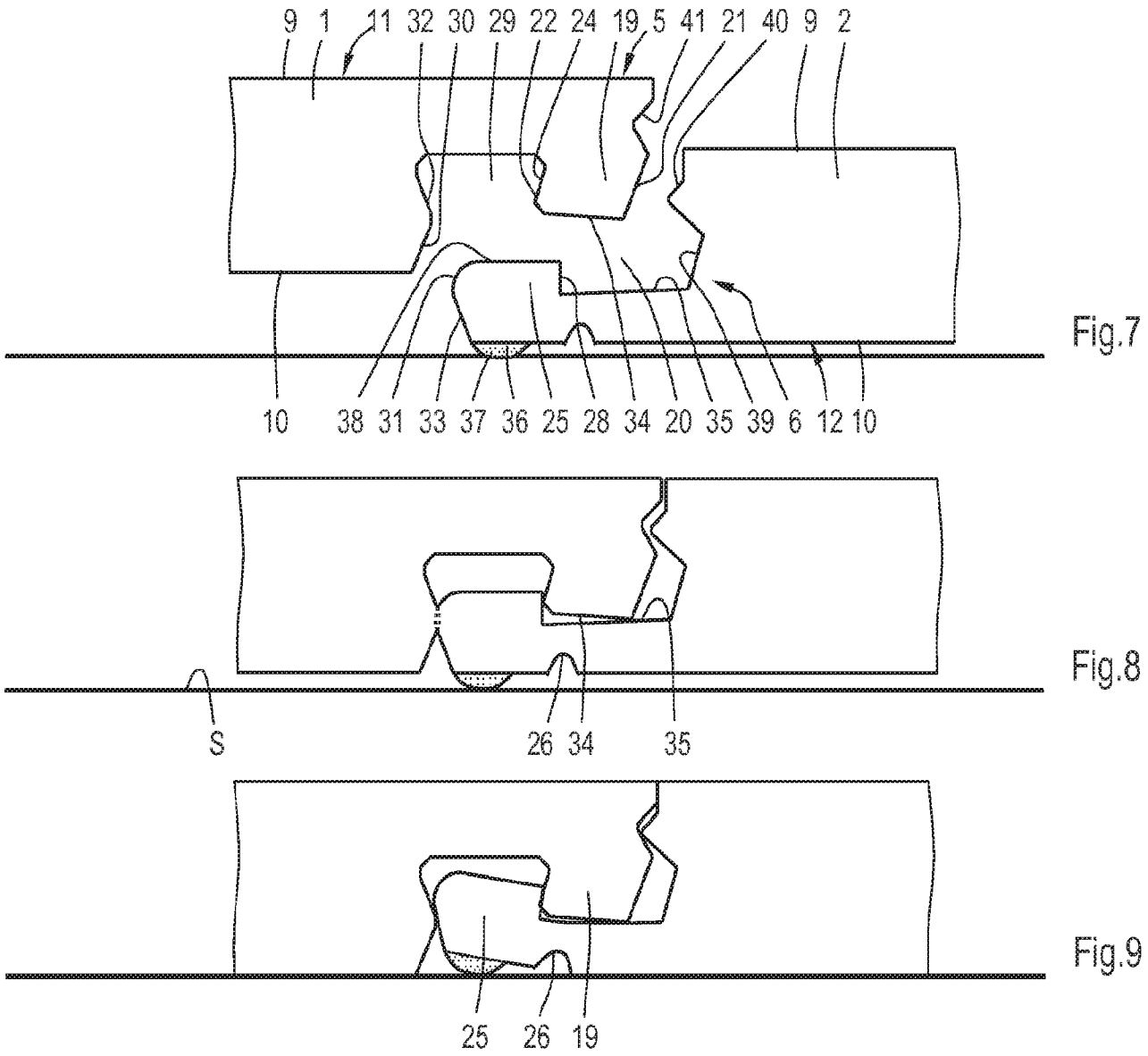
FIGS. 7-9 are similar views as FIGS. 4-6 of an alternative embodiment of a set of panels.
Figure 10:
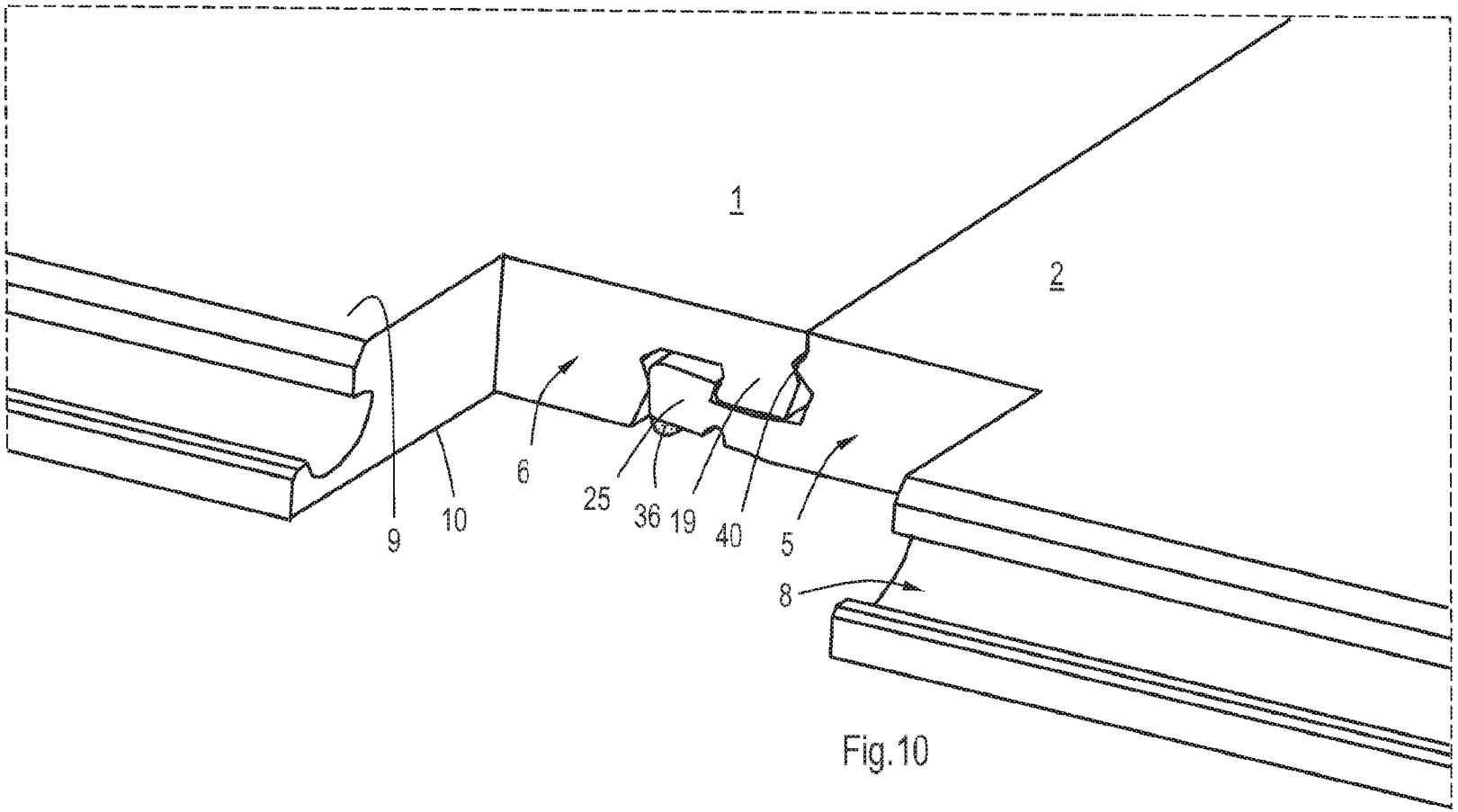
FIG. 10 is a similar view as FIG. 3, but showing the alternative embodiment of FIGS. 7-9.

FIGS. 7-10 show an alternative embodiment of a set of panels according to the invention. Similar to FIGS. 3-6 the condition in FIG. 8 represents an intermediate condition in which the panels 1, 2 are interengaged but still not locked to each other, whereas FIG. 9 illustrates the locked condition. In FIGS. 7-10 corresponding parts are indicated by the same reference signs as in FIGS. 3-6. It is noted that in FIGS. 4-6 the first panel 1 is shown at the right side of the drawing, whereas in FIGS. 7-9 it is shown at the left side.

In the embodiment as shown in FIGS. 7-10 the panels 1, 2 are resilient. The bottom surface 35 of the female part 12 of the second panel 2 is inclined in a direction from the back face 10 to the front face 9, in this case upwardly, as seen from the outer side 31 of the locking member 25. The inclination of the bottom surface 35 is steeper than of the lower surface 34 of the tongue 19 in unlocked condition, as seen in the same direction from the outer side 31 of the locking member 25 and shown in FIG. 8; in this case the lower surface 34 is even slightly declined in the mentioned direction. This means that in the interengaged condition before the locking action, as shown in FIG. 8, a portion of the lower surface 34 at the front side 21 of the tongue 19 contacts the bottom surface 35. This is shown in FIG. 8 where an open space is present between a portion of the lower surface 34 at the inner side 22 of the tongue 19 and the bottom surface 35. It is also possible, that the lower surface 34 extends substantially parallel to the front face 9 of the first panel 1, whereas the bottom surface 35 extends substantially parallel to the upper face 9 of the second panel 2 only in the locked condition of the panels 1, 2.

Figure 31:
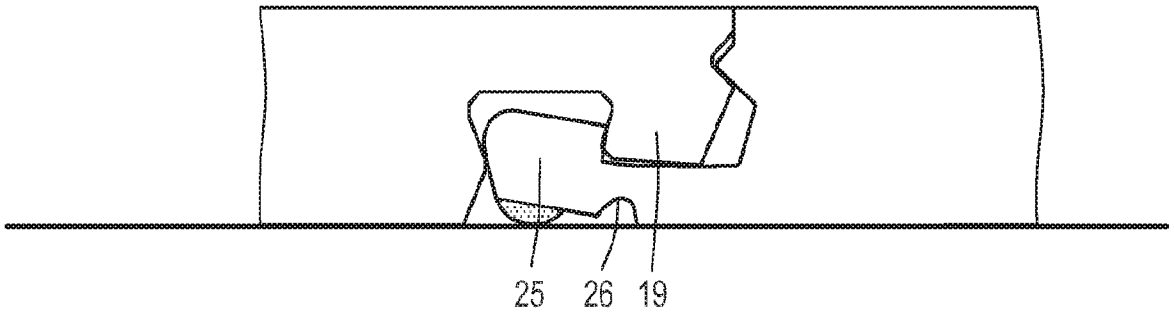
Figure 32:
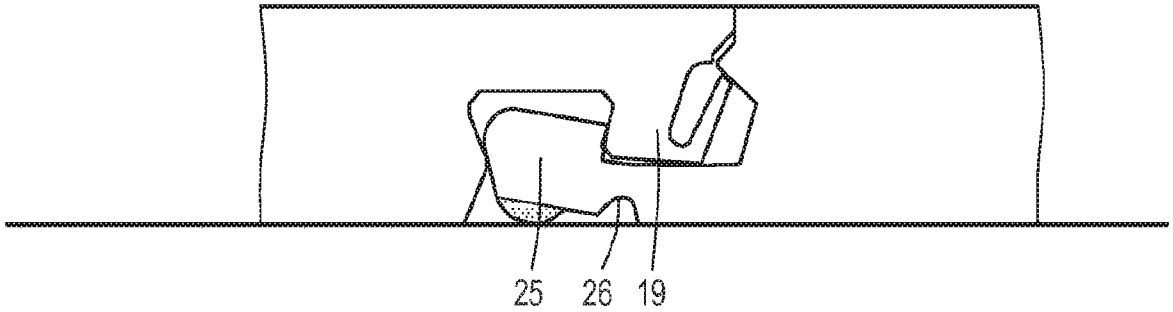

FIG. 8 also shows an overlap of the groove wall 30 and the outer side 31 of the locking member 25 by means of broken lines in order to illustrate the elastic properties and local deformation of the panels 1, 2. This means that during the locking action a certain resistance must be overcome to interlock the panels 1, 2. It is also noted that in the situation as shown in FIG. 8 the outer side 21 of the tongue 19 does not contact the frontal edge portion 39 of the second panel 2. It is, however, conceivable that already in this condition the outer side 21 of the tongue 19 does contact the frontal edge portion 39 such that the panels 1, 2 are interlocked in a direction substantially parallel to the front faces 9 and substantially perpendicular to their edges 5, 6. In the latter case the panels 1, 2 may also be interlocked already in a direction substantially perpendicular to the upper faces 9 due to the protrusion 40 which is snapped into the recess 41, on the one hand, and abutment of the lower surface 34 to the bottom surface 35, on the other hand. In the locked condition the locking member 25 may clamp the tongue 19 between the stop surface 28 and the frontal edge portion 39 and in case of flexible panels 1, 2 local deformation at the male part 11 and the female part 12 may occur. Due to the inclined orientation of the locking surface 24 and the stop surface 28 in the locked condition the tongue 19 is locked in horizontal as well as in vertical direction by the locking member 25. FIG. 31 shows an alternative embodiment in which a contact surface between the panels 1 and 2 at the protrusion 40 is wider than in the embodiment as shown in FIG. 9. FIG. 32 shows a further alternative embodiment which comprises a resilient lip at the male part 11 in order to create a snap fastener for mutually locking the panels 1, 2 in a direction substantially perpendicular to the front faces of the panels. In case of manufacturing the panels by means of extrusion it might be more easy to create the resilient lip than by means of milling the desired profile.

Figure 34:
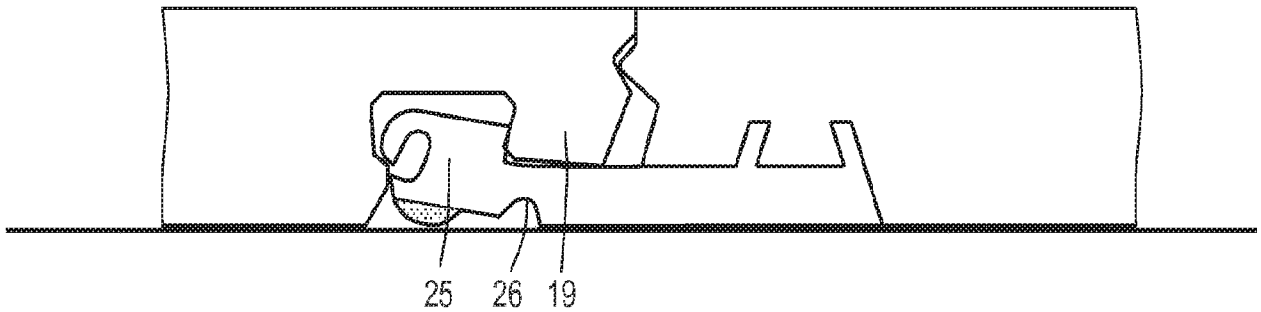
FIGS. 31-34 are similar views as FIG. 9 of alternative embodiments.
Figure 33:
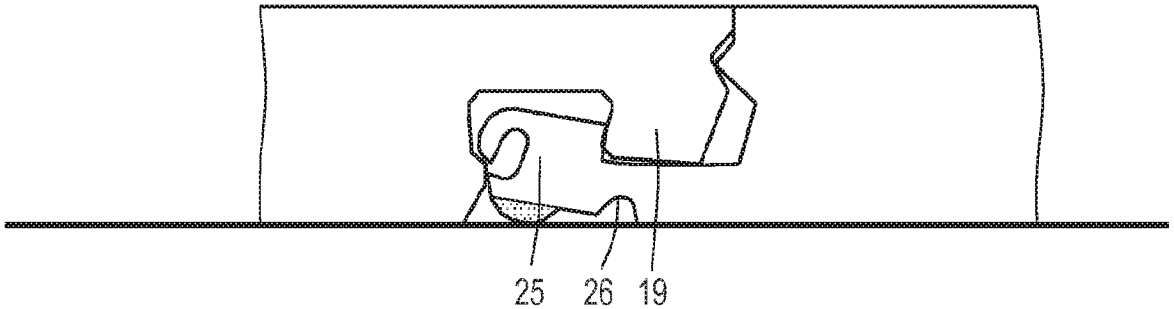

Upon pressing the tongue 19 of the first panel 1 onto the bottom surface 35 of the second panel 2 when the panels 1, 2 are placed on the basis S a reaction force will be exerted onto the actuator 36 in upward direction. Consequently, the locking member 25 will be pressed into the groove 29 between the inner side 22 of the tongue 19 and the groove wall 30. FIG. 9 shows that the locking surface 24 cooperates with the stop surface 28 in the locked condition, whereas the locking member 25 is maintained in a fixed position with respect to the first and second panel 1, 2 by the protrusion 32 on the groove wall 30 that contacts the inclined portion 33 at the outer side 31 of the locking member 25. FIG. 33 shows an alternative embodiment in which the locking member 25 is provided with a resilient lip that functions as a holding element for holding the locking member 25 in a fixed position with respect to the panels 1, 2 in locked condition thereof. FIG. 34 shows another embodiment in which the locking member 25 is part of a separate strip that is fixed to the remainder of the second panel 2. Numerous alternative manners for fixing the separate strip are conceivable.

It is noted that in the embodiment as shown in FIGS. 7-9 the stop surface 28 of the locking member 25 extends substantially perpendicularly to the front face 9 of the second panel in unlocked condition, but is directed to its back face 10 in locked condition. This is advantageous in case the female part 12 is manufactured by machining the second panel 2, since a stop surface 28 which extends substantially perpendicularly to the front face 9 of the second panel 2 can be made easier than an inclined stop surface 28 which is directed in a direction from the front face 9 to the back face 10. Nevertheless, milling a negative angle, i.e. the stop surface 28 is directed to the back face 10 of the second panel 2, remains possible; in combination with displacing the locking member 25 by means of pivoting the negative angle becomes larger in the locked condition, which is advantageous for locking in a direction substantially perpendicular to the upper faces 9 of the panels 1, 2.

Figure 30:
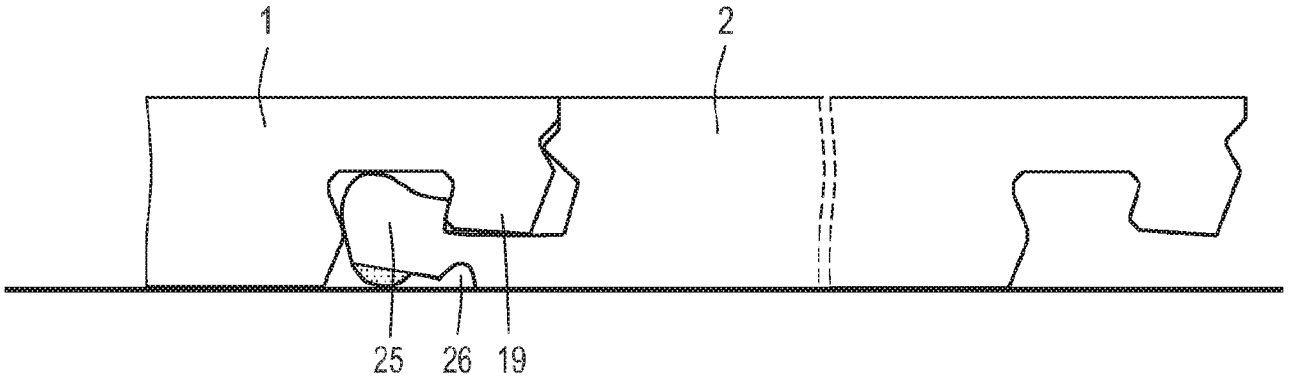
FIG. 30 is a similar view as FIG. 9 of an alternative embodiment.

FIG. 9 shows that in locked condition of the panels 1, 2 the free end 38 of the locking member 25 which is located at a distance from the actuator 36 and directed in a direction from the back face 10 to the front face 9 of the second panel 2 is free from the first panel 1. This may be different in an alternative embodiment as shown in FIG. 30, where the free end 38 of the locking member 25 contacts the first panel 1.

Figure 27:
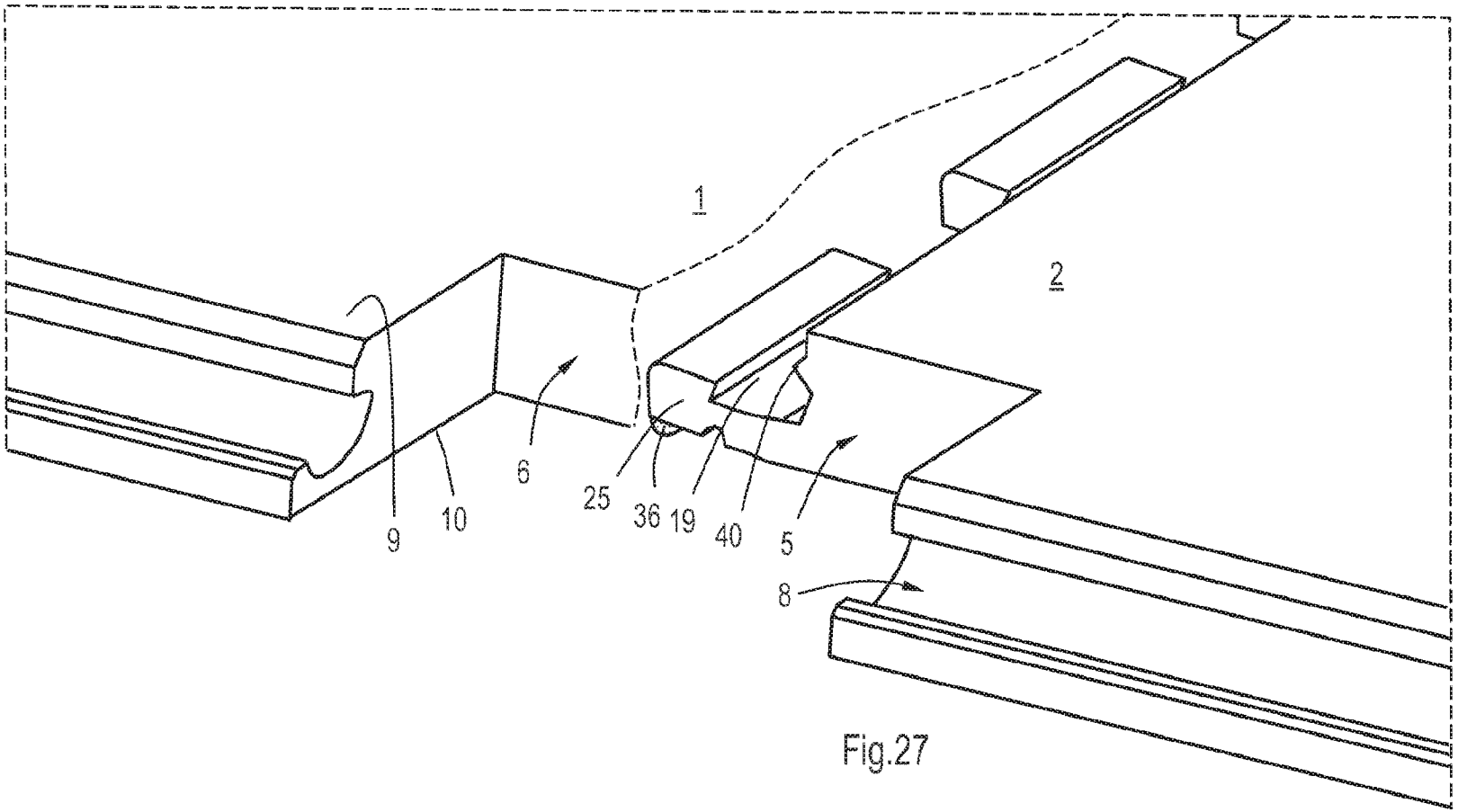
FIG. 27 is a perspective cut-away view, showing an alternative embodiment of FIG. 10.

FIG. 27 shows an alternative embodiment in which the locking member 25 is discontinuous along the second edge 6 of the second panel 2. The locking member 25 comprises separate portions. Similarly, the tongue 19 of the male part 11 may be discontinuous along the second edge 6 as well, but this is not essential.

Figures 11, 12, 13:
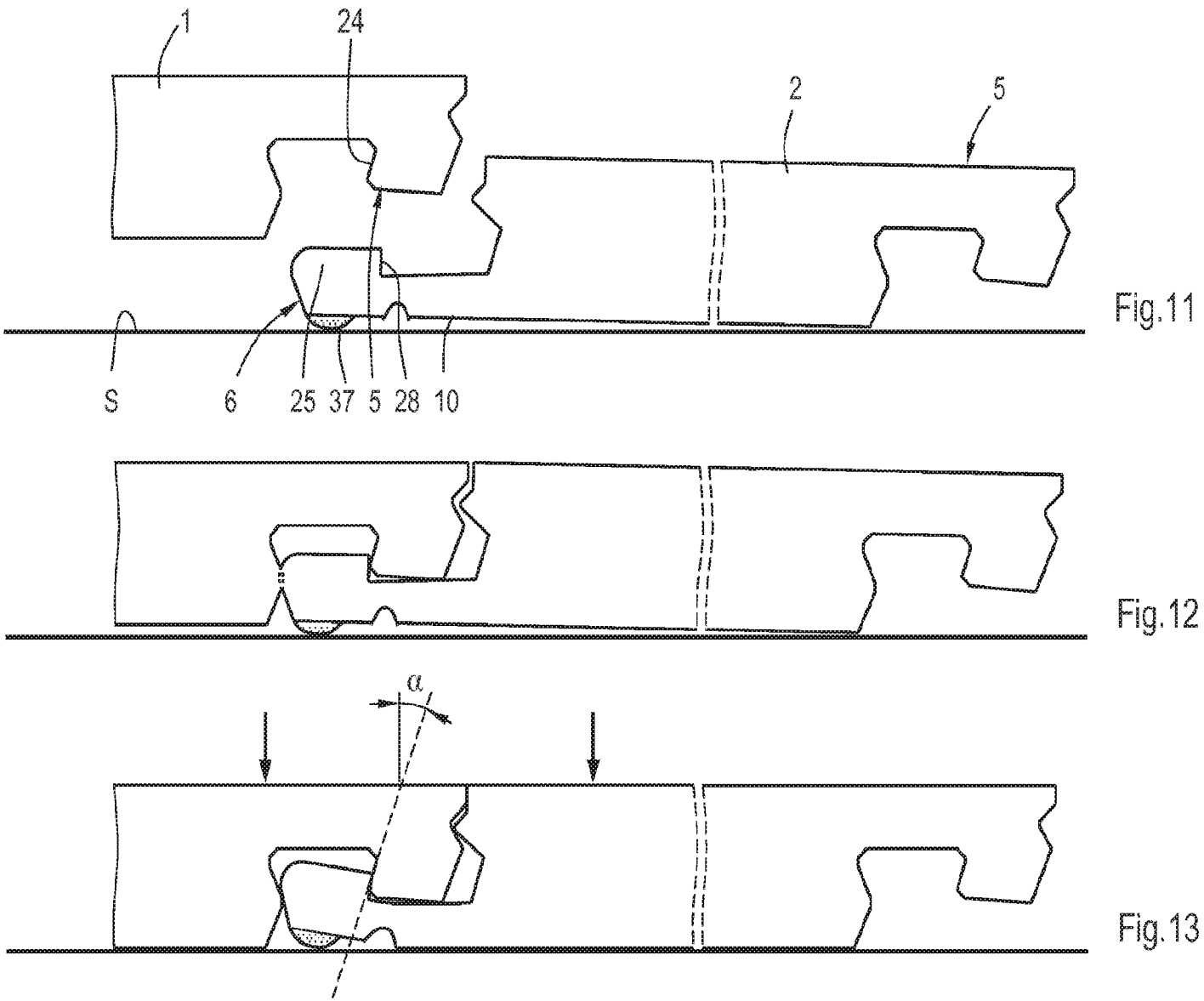
FIGS. 11-13 are similar views as FIGS. 7-9, but illustrating an alternative way of laying the panels.

FIGS. 11-13 illustrate an alternative manner of joining the panels 1, 2. Compared to FIGS. 7-9 both opposite first edge 5 and second edge 6 of the second panel 2 are shown. It can be seen in FIG. 12 that the second panel 2 at its first edge 5 rests on the basis S, whereas at its second edge 6 the control surface 37 of the actuator 36 at the locking member 25 contacts the basis S. Therefore, the second panel 2 is tilted with respect to the horizontal basis S. If the second panel 2 is very flexible the cross section as shown in FIGS. 11 and 12 may be curved. FIG. 13 illustrates the panels 1, 2 in locked condition after the first panel 1 is pressed onto the second panel 2.

Furthermore, FIG. 13 illustrates that the orientation of the stop surface 28 of the female part 12 has changed from a substantially vertical orientation to a negative angle a in the locked condition, extending between the stop surface 28 and a plane substantially perpendicular to the upper face 9 of the second panel 2. The angle a is called negative since the stop surface 28 is inclined backwards as seen from the center of the second panel 2. It is clear that the negative angle a must be limited in case the male part 11 and female part 12 are manufactured by means of mechanical machining. Due to the cooperating inclined stop surface 28 and locking surface 24 in locked condition of the panels 1, 2 the panels will not be de-locked unintentionally in case of applying a load close to the male part 11 and female part 12, for example, such as illustrated by arrows in FIG. 13. This is advantageous with respect to conventional locking systems on the market.

Figure 14:
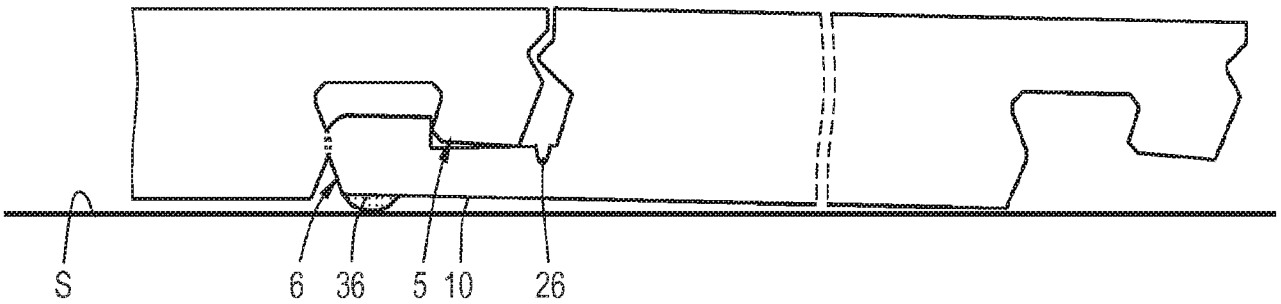
FIGS. 14-15 are similar views as FIGS. 12-13, but showing an alternative embodiment.
Figure 15:
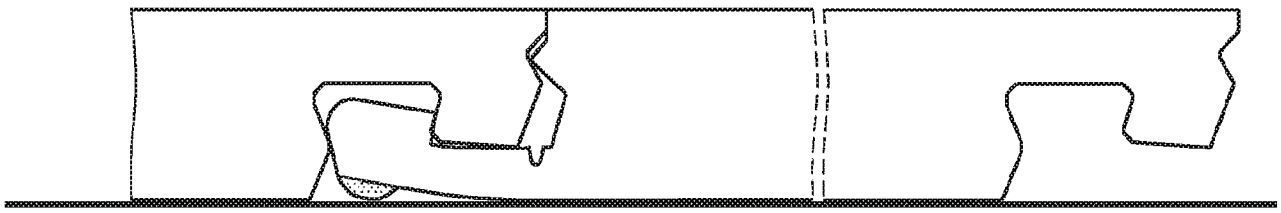
Figure 16:
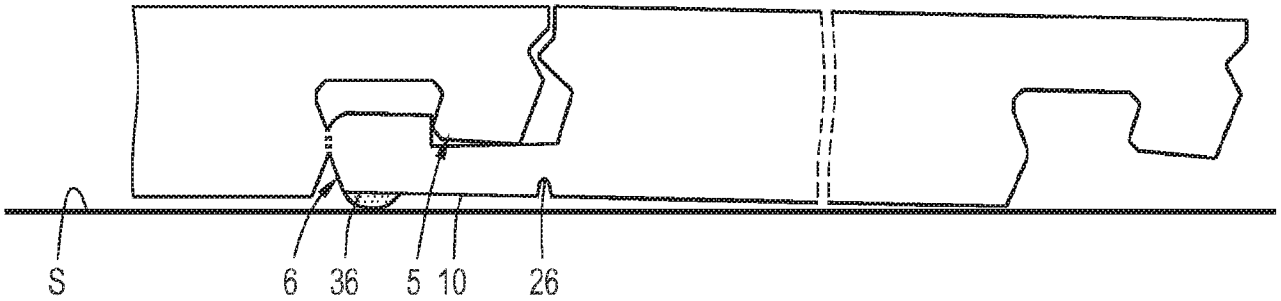
FIGS. 16-17 are similar views as FIGS. 14-15, but showing an alternative embodiment.
Figure 17:
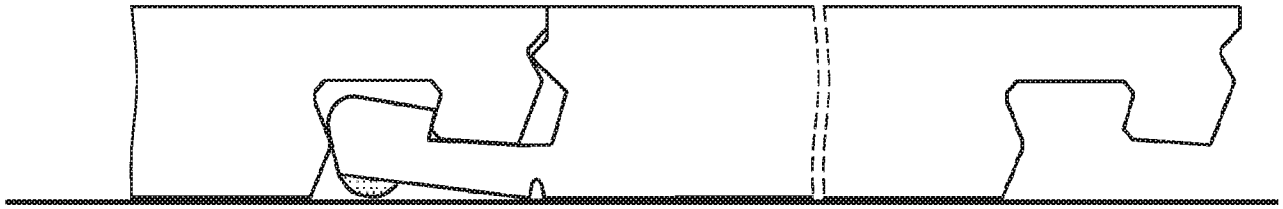

FIGS. 14 and 15, on the one hand, and FIGS. 16 and 17, on the other hand, show respective alternative embodiments of the set of panels according to the invention. In these embodiments the recesses 26 for forming a living hinge are located beyond a contact surface between the lower surface 34 of the male part 11 and the bottom surface 35 of the female part 12 as seen from the outer side 31 of the locking member 25. In the embodiment as shown in FIGS. 14 and 15 the recess 26 is located in the bottom surface 35, whereas in the embodiment as shown in FIGS. 16 and 17 the recess 26 is located in the back face 10 of the second panel 2 at the female part 12. In these cases the male part 11 and the female part 12 are dimensioned such that in the locked condition the contact surface between the lower surface 34 of the male part 11 and the bottom surface 35 of the female part 12 form a relatively wide strip along the edges 5, 6.

Figure 21:
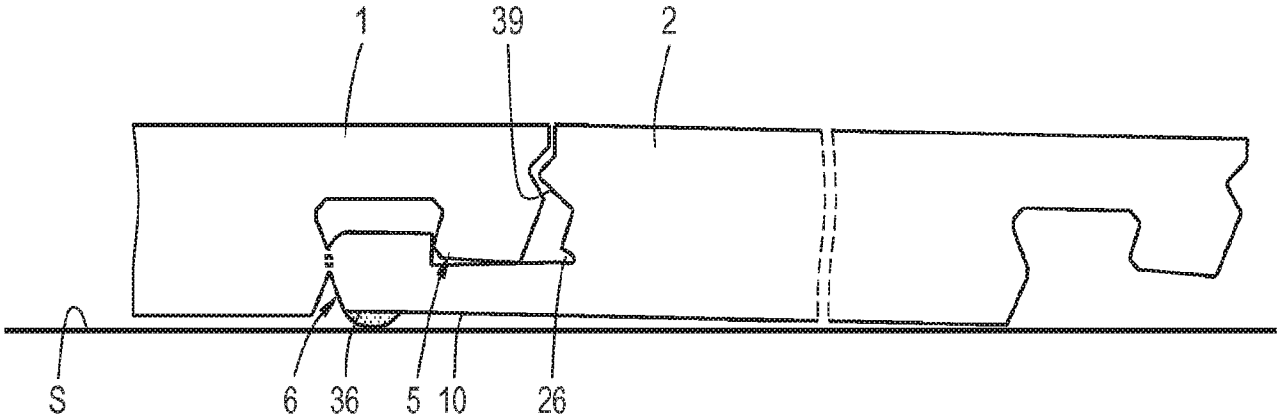
FIGS. 21-22 are similar views as FIGS. 14-15, but showing an alternative embodiment.
Figure 22:
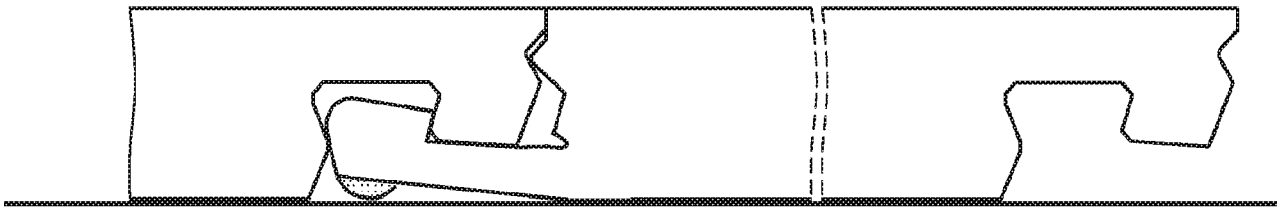

FIGS. 21 and 22 show still another embodiment, where the recess 26 is located in the frontal edge portion 39 of the second panel 2. It may be clear that the recess 26 may have numerous different locations at the female part 12. Besides, the recess 26 may have several dimensions and/or shapes, for example a V-shape or U-shape or the like, and extend along a part of the second edge 6 or along the entire second edge 6.

Figures 18, 19, 20:
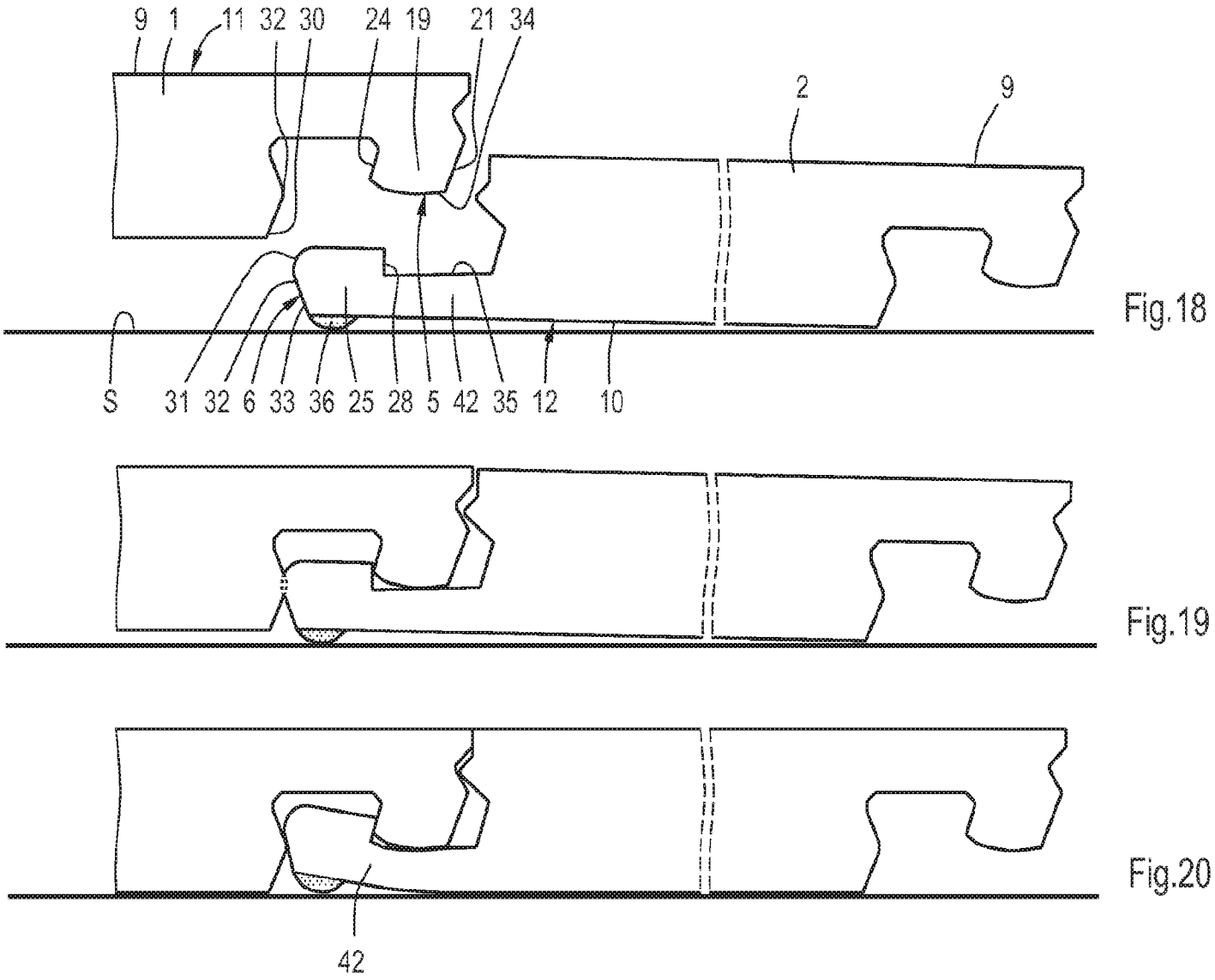
FIGS. 18-20 are similar views as FIGS. 11-13, but showing an alternative embodiment of a set of panels.

FIGS. 18-20 show an alternative embodiment of a set of mutually lockable panels according to the invention. The panels are comparable to the panels as shown in FIGS. 11-13, but in this case a recess for forming a living hinge is absent at the female part 12. As illustrated in FIG. 20, which shows the locked condition, there is no single pivot axis at the female part 12. The bottom surface 35 is a substantially flat surface and slightly inclined in a direction from the back face 10 to the front face 9 as seen from the outer side 31 of the locking member 25. The lower surface 34 of the tongue 19 has a curved cross-section. In the interengaged condition before the locking action, as shown in FIG. 19, a portion of the lower surface 34 at the outer side 21 of the tongue 19 contacts the bottom surface 35. FIG. 19 also shows a small overlap of the groove wall 30 and the outer side 31 of the locking member 25 by means of broken lines in order to illustrate the elastic properties and local deformation of the panels 1, 2.

In the embodiment as shown in FIGS. 18-20 the female part 12 comprises the locking member 25 and a bendable portion 42 which forms an intermediate portion between the locking member 25 and the rest of the second panel 2. The bendable portion 42 forms a horizontally oriented lip that extends along the second edge 6 of the second panel 2. Due to the presence of the bendable portion 42 the locking member 25 can be moved upwardly as illustrated in the embodiments described hereinbefore. However, the locking member 25 is not pivoted about a single pivot axis, but it is moved from its first position in unlocked condition to its second position in locked condition by means of bending the bendable portion 42. The bendable portion 42 is bendable with respect to a bending axis which extends substantially parallel to the second edge 6. When the second panel 2 is considered separately and the actuator 36 is pressed upwardly upon pressing the second panel 2 downwardly onto the basis S, the bending axis may be located at the root of the lip 42 opposite to the side where the locking member 25 is disposed.

The bending axis is considered to have a substantially fixed portion with respect to the second panel 2 and the locking member 25 is displaceable with respect to the bending axis upon bending the bendable portion 42. In this case, however, the bending axis is determined by the shape of the contact surface between the lower surface 34 and the bottom surface 35 such that the bending axis will shift towards the locking member 25 during a locking action. In fact, the bendable portion 42 is bent about the lower surface 34. FIG. 20 shows that in the locked condition the stop surface 28 of the locking member 25 cooperates with the locking surface 24 of the male part 11. In the locked condition as shown in FIG. 20 the back face 10 of the second panel 2 is bent about a bending center which lies at a distance from the bendable portion 42, in this case above the second panel 2. A portion of the lower surface 34 of the tongue 19 may have a curvature about a center which substantially coincides with the bending center.

The locking member 25 is maintained in a fixed position with respect to the first and second panel 1, 2 by the protrusion 32 on the groove wall 30 that contacts the inclined portion 33 at the outer side 31 of the locking member 25, as illustrated in FIG. 20. It is noted that the locking member 25 and the rest of the second panel 2 may be made of the same material as the bendable portion 42, for example LVT or the like, but alternative materials are conceivable. The actuator may be formed from a cured liquid, that can be printed and cured on the back face of the second panel at the locking member. Alternative manners of applying a protrusion are conceivable, for example by means of extrusion of a material, or applying a curable material by means of a valve jet, or during pressing the panels, or during laminating the panels, or the like. It is also possible to create a ridge by means of removing material adjacent to the intended protrusion.

Figure 23:
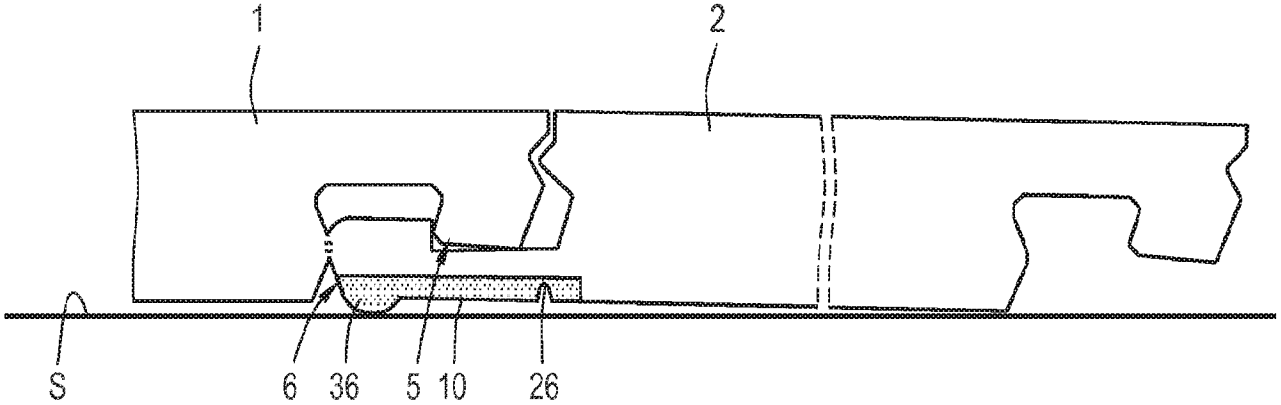
FIGS. 23-24 are similar views as FIGS. 14-15, but showing an alternative embodiment.
Figure 24:
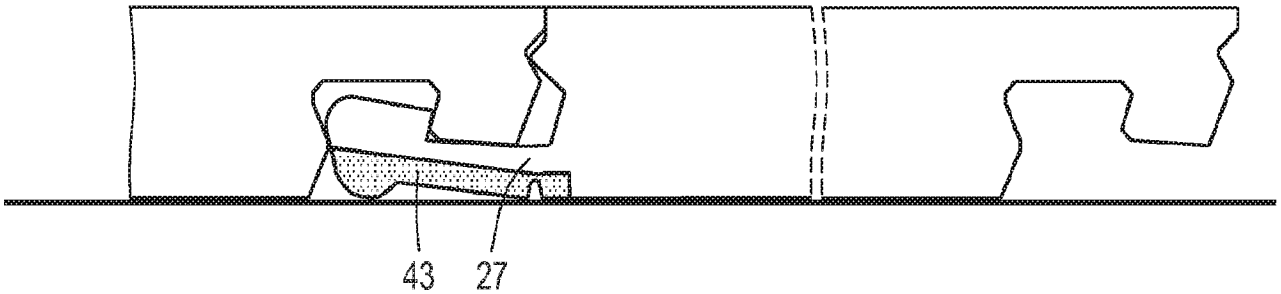
Figure 25:
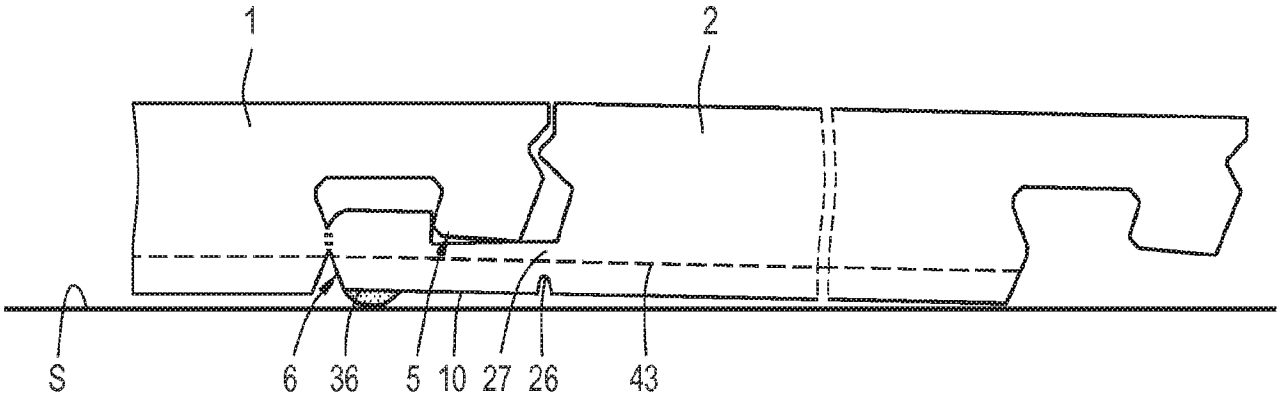
FIGS. 25-26 are similar views as FIGS. 14-15, but showing an alternative embodiment.
Figure 26:
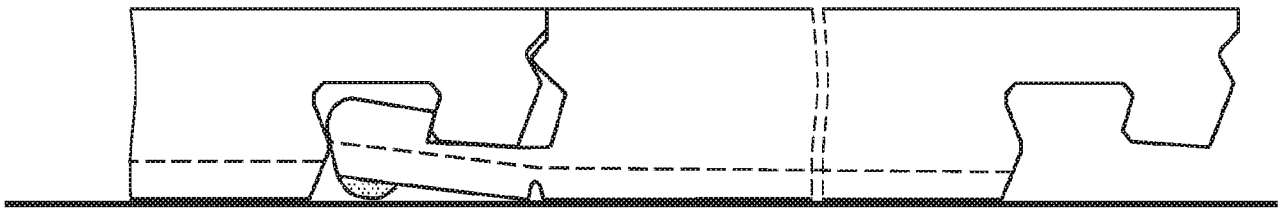

Turning back to the embodiments of the panels 1, 2 including a recess 26 and a living hinge 27 it may be desirable to reinforce the living hinge 27 and to avoid any weak portion or even cracks at that location after a locking action. FIGS. 23 and 24 show an embodiment of a set of panels 1, 2 in which a reinforcement portion 43 is provided at the back face 10 of the second panel 2 at the female part 12. In this case the reinforcement portion 43 comprises a layer which is tougher than the remainder of the second panel 2 and which includes the actuator 36, but the reinforcement portion 43 may be limited to the area around the living hinge 27 or may be extended to a larger portion of the second panel 2. The reinforcement layer may be made of a curable substance such as a glue. FIGS. 25 and 26 show an alternative embodiment, in which the reinforcement portion 43 forms a layer which is incorporated in the panels 1, 2 between the front and back faces 9, 10. This layer may be a glass fibre sheet, a grid-shaped layer, or the like.

Figure 28:
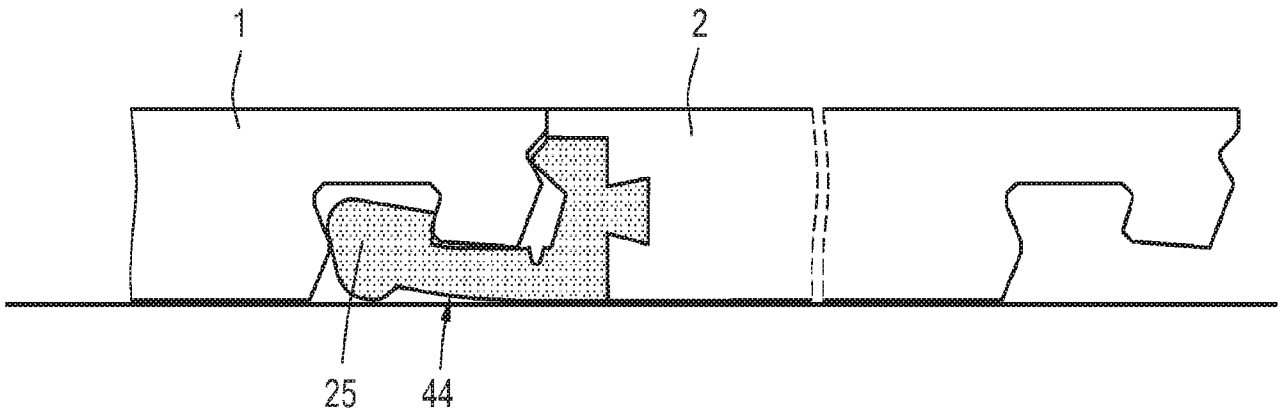
FIGS. 28-29 are similar views as FIG. 15, but showing alternative embodiments.
Figure 29:
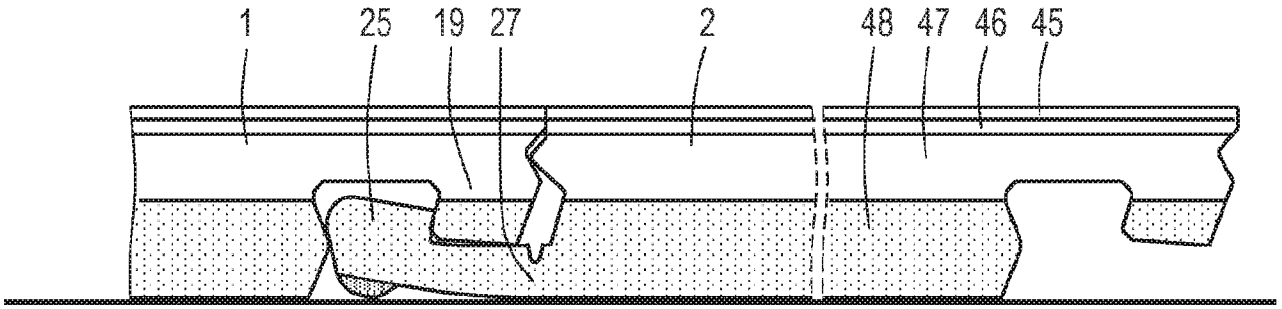

FIGS. 28 and 29 show embodiments of panels 1, 2 that comprise regions of different material properties. FIG. 28 illustrates that the female part 12 is mainly made of a different material than the remainder of the second panel 2. For example, the female part 12 is more flexible than the remainder of the second panel 2 in order to minimize tension in the locked condition. The female part 12 may comprise a separate part 44 which is fixed to the rest of the second panel 2, for example by means of glue. It is also conceivable that the second panel 2 is made of one piece by means of co-extruding different materials.

FIG. 29 shows an alternative embodiment of laminated panels 1, 2, including a top layer 45 and a decorative layer 46. The panels, 1, 2 are provided with a core which has an upper portion 47 and a lower portion 48 which are made of different materials, for example by means of co-extrusion. In this case the flexibility of the lower portion 48 is higher than of the upper portion 47. The location of a transfer plane between the upper portion 47 and the lower portion 48, extending substantially parallel to the upper face 9, is selected such that the locking member 25 and the region around the living hinge 27 are made of the flexible material, whereas only a portion of the tongue 19 at the lower surface 34 thereof is made of the flexible material. The upper portion 47 may comprise PVC having a higher chalk content than the lower portion 48, such that the lower portion 48, which must allow relatively large deformations, is less brittle. It may be clear, that numerous variations of shapes and dimensions of regions of different material properties are conceivable. The layers of different material properties may also be made by means of a laminating process which may be easier in terms of manufacturing than by means of co-extrusion.

The dimensions of the panels 1, 2 as shown in FIGS. 7-29 may vary. In order to give an indication of the possible dimensions of a practical embodiment the following dimensions of a panel are just an example, without limiting the scope of the claims. The thickness of the panel as measured between the front face 9 and the back face 10 is 4 mm. The distance between the front face 9 and the lower surface 34 of the tongue 19 is 2.75 mm and the distance between the inner side 24 and the outer side 21 of the tongue 19, as measured substantially parallel to the front face 9, is 2.38 mm. The lower surface 34 extends substantially parallel to the front face 9. The thickness of the panel between the groove wall 30 and the inner side 24 of the tongue 19 is 1.55 mm. The angle between the front face 9 and the outer side 21 of the tongue 19, as measured at the outer side of the panel, is 115°. The angle between the front face 9 and the inner side 24 of the tongue 19, as measured at the outer side of the panel is 85°. The distance between the outer side 21 of the tongue 19 and the groove wall 30, as measured substantially parallel to the front face 9, is 4.88 mm. The angle between the back face 10 and a portion of the groove wall 30 extending between the protrusion 32 and the front face 9, as measured at the outer side of the panel, is 105°, whereas the angle between the back face 10 and a portion of the groove wall 30 extending between the protrusion 32 and the back face 10, as measured at the outer side of the panel, is 71°. The distance of the protrusion 32 from the front face 9 is 3.05 mm.

The dimensions at the female part 12 in unlocked condition of the panels are as follows. The distance between the frontal edge portion 39 and the outer side 31 of the locking member 25 is 5.18 mm. The angle between the back face 10 and the bottom surface 35, as measured at the inner side of the panel, is 4°. The angle between the back face 10 and the inclined portion 33 at the outer side 31 of the locking member 25, as measured at the outer side of the panel, is 65°. The distance between the outer side 31 and the stop surface 28 is 2.54 mm. The angle between the back face 10 and the stop surface 28, as measured at the inner side of the panel, is 95°. Thus, as seen from the panel, the inclination of the stop surface 28 is directed outwardly in a direction from the back face 10 to the front face 9 such that the stop surface 28 is directed in a direction from the back face 10 to the front face 9. When disregarding the recess 26 the thickness of the lip between the stop surface 28 and the frontal edge portion 39 varies between 1.06 and 1.52 mm. The distance between the back face 10 and the free end 38 of the locking member 25 is 1.75 mm, when disregarding the actuator 36.

It is noted that in the embodiments of the set of panels as described hereinbefore, either in case of pivoting the locking member or in case of moving the locking member by means of bending a bendable portion, the female portion is in fact engaging the male part such that the panels are locked with respect to each other in a direction substantially perpendicular to their upper faces as well as in a direction substantially parallel to their upper faces and substantially perpendicular to their edges. In a particular case the male member is clamped by the female part, for example supported by flexible portions of the panels or entirely flexible panels.

The invention is not limited to the embodiments shown in the drawings and described hereinbefore, which may be varied in different manners within the scope of the claims and their technical equivalents. For example, the panels may have an alternative shape than rectangular. Selecting displacement of the locking member by means of either pivoting or bending may depend inter alia on material properties. It is also conceivable that the locking member is moved by means of a combination of pivoting and bending.

The invention claimed is:

1. A set of mutually lockable panels comprising:

a first panel having a front face, a back face and an edge including a male part which is directed in a direction from the front face of the first panel to the back face of the first panel; and a second panel having a front face, a back face and an edge including a female part configured to receive the male part of the first panel in unlocked condition of the panels;

wherein the male part has an outer side which, in a locked condition of the panels, is directed to the second panel, and an opposite inner side which is provided with a locking surface;

wherein the female part comprises a locking member, wherein the locking member has a stop surface, which stop surface cooperates with the locking surface of the male part in locked condition of the panels so as to lock the panels with respect to each other at least in a direction substantially perpendicular to the locking surface and the stop surface;

wherein the locking member is formed integral with the second panel;

wherein the edge of the first panel comprises a male part and a groove;

wherein the groove is configured for receiving the locking member of the female part, wherein the groove comprises a groove wall at a proximal end of the groove; and wherein in the locked condition the locking member is maintained in position with respect to the first and second panel by a holding element comprising a snap fastener, wherein the snap fastener is provided by a protrusion on the groove wall of the first panel that fits behind an inclined portion at the outer side of the locking member;

wherein the second panel comprises a lip, wherein the locking member is connected to the second panels by means of said lip, wherein the lip defines a first recess along the back face, said recess is located at a distal end of the locking member and extending continuously proximally to beyond the locking member.

2. The set of panels according to claim 1, wherein the stop surface comprises a first contact surface, wherein the locking surface comprises a second contact surface, wherein in locked condition of the panels the first contact surface contacts the second contact surface, wherein in unlocked condition of the panels, the angle between the first contact surface and the front face differs from the angle between the second contact surface and the front face.

3. The set of panels according to claim 2, wherein in the locked condition of the panels the first contact surface contacts the second contact surface in a plane that is not substantially perpendicular to the front face of the locked panels.

4. The set of panels according to claim 1, wherein in locked condition the stop surface and the locking surface exert a pressure force upon each other.

5. The set of panels according to claim 4, wherein the pressure force is provided by the locking member being in a bent condition.

6. The set of panels according claim 1, wherein the outer side of the male part and an edge portion of the second panel which is opposite thereto in the locked condition of the panels are provided with a snap fastener configured to mutually lock the first panel to the second panel in a direction substantially perpendicular to the front faces of the panels.

7. The set of panels according to claim 6, wherein the snap fastener is provided by a protrusion at the outer side of the male part that fits in a second recess in the edge portion of the second panel.

8. The set of panels according to claim 1, wherein the male part and the female part are dimensioned such that in a locked condition of the panels the locking member presses the outer side of the male part against the second panel.

9. The set of panels according to claim 1, wherein the panels are made of a material selected from LVT (Luxury Vinyl Tile), MDF (Medium Density Fiberboard), HDF (High Density Fiberboard), mineral materials, or WPC (Wood Plastic Composites).

10. The set of panels according to claim 1, wherein the panels are rectangular and two remaining opposite edges of each panel have a tongue and a groove, respectively, which are configured to couple similar panels along said edges by angling the tongue in the groove, or wherein two remaining opposite edges of each panel are configured with the male part and the female part, to couple the panels by a displacement substantially perpendicular to the front faces of the panels.

11. A set of mutually lockable panels comprising:

a first panel having a front face, a back face and an edge including a male part which is directed in a direction from the front face of the first panel to the back face of the first panel;

a second panel having a front face, a back face and an edge including a female part configured to receive the male part of the first panel in unlocked condition of the panels;

wherein the male part has an outer side which, in a locked condition of the panels, is directed to the second panel, and an opposite inner side which is provided with a locking surface;

wherein the female part comprises a locking member, wherein the locking member has a stop surface, which stop surface cooperates with the locking surface of the male part in locked condition of the panels so as to lock the panels with respect to each other at least in a direction substantially perpendicular to the locking surface and the stop surface; and wherein the locking member is formed integral with the second panel;

wherein the edge of the first panel comprises a male part and a groove;

wherein the groove is configured for receiving the locking member of the female part, wherein the groove comprises a groove wall at a proximal end of the groove;

wherein in the locked condition the locking member is maintained in position with respect to the first and second panel by a holding element comprising a snap fastener, wherein the snap fastener is provided by a protrusion on the groove wall of the first panel that fits behind an inclined portion at the outer side of the locking member, wherein the first panel and the second panel each comprise a top layer, a decorative layer and a core, wherein the core comprises an upper portion and a lower portion, wherein the upper portion is provided closer to the front face than the lower portion, wherein the upper portion and the lower portion are made of different materials, wherein the locking member is fully provided closer to the back face than the bottom face of the upper portion, wherein a back part of the male part is provided in the lower portion;

wherein the second panel comprises a lip, wherein the locking member is connected to the second panels by means of said lip, wherein the lip defines a first recess along the back face, said recess is located at a distal end of the locking member and extending continuously proximally to beyond the locking member.

12. The set of panels according claim 11, wherein the outer side of the male part and an edge portion of the second panel which is opposite thereto in the locked condition of the panels are provided with a snap fastener configured to mutually lock the first panel to the second panel in a direction substantially perpendicular to the front faces of the panels.

13. The set of panels according to claim 11, wherein the upper portion and the lower portion comprise polyvinyl chloride.

14. A set of mutually lockable panels comprising:

a first panel having a front face, a back face and an edge including a male part which is directed in a direction from the front face of the first panel to the back face of the first panel; and a second panel having a front face, a back face and an edge including a female part configured to receive the male part of the first panel in unlocked condition of the panels;

wherein the male part has an outer side which, in a locked condition of the panels, is directed to the second panel, and an opposite inner side which is provided with a locking surface;

wherein the female part comprises a locking member, wherein the locking member has a stop surface, which stop surface cooperates with the locking surface of the male part in locked condition of the panels so as to lock the panels with respect to each other at least in a direction substantially perpendicular to the locking surface and the stop surface; and wherein the locking member is formed integral with the second panel;

wherein the edge of the first panel comprises a male part and a groove;

wherein the groove is configured for receiving the locking member of the female part, wherein the groove comprises a groove wall at a proximal end of the groove;

wherein in the locked condition the locking member is maintained in position with respect to the first and second panel by a holding element comprising a snap fastener, wherein the snap fastener is provided by a protrusion on the groove wall of the first panel that fits behind an inclined portion at the outer side of the locking member;

wherein the first panel and the second panel each comprise a top layer, a decorative layer and a core, wherein the core comprises an upper portion and a lower portion, wherein the upper portion is provided closer to the front face than the lower portion, wherein the upper portion and the lower portion are made of different materials, wherein the locking member is fully provided closer to the back face than the bottom face of the upper portion;

wherein both the upper portion and the lower portion comprise chalk.

15. The set of panels according to claim 14, wherein the stop surface comprises a first contact surface, wherein the locking surface comprises a second contact surface, wherein in locked condition of the panels the first contact surface contacts the second contact surface, wherein in unlocked condition of the panels, the angle between the first contact surface and the front face differs from the angle between the second contact surface and the front face.

16. The set of panels according to claim 15, wherein in the locked condition of the panels the first contact surface contacts the second contact surface in a plane that is not substantially perpendicular to the front face of the locked panels.

17. The set of panels according to claim 14, wherein in locked condition the stop surface and the locking surface exert a pressure force upon each other.

18. The set of panels according to claim 17, wherein the pressure force is provided by the locking member being in a bent condition.

19. The set of panels according claim 14, wherein the outer side of the male part and an edge portion of the second panel which is opposite thereto in the locked condition of the panels are provided with a snap fastener configured to mutually lock the first panel to the second panel in a direction substantially perpendicular to the front faces of the panels.

20. The set of panels according to claim 19, wherein the snap fastener is provided by a protrusion at the outer side of the male part that fits in a second recess in the edge portion of the second panel.

21. The set of panels according to claim 14, wherein both the upper portion and the lower portion comprise polyvinyl chloride.

22. The set of panels according to claim 14, wherein a back part of the male part is provided in the lower portion.

23. The set of panels according to claim 14, wherein the male part and the female part are dimensioned such that in a locked condition of the panels the locking member presses the outer side of the male part against the second panel.

24. The set of panels according to claim 14, wherein the panels are made of a material selected from LVT (Luxury Vinyl Tile), MDF (Medium Density Fiberboard), HDF (High Density Fiberboard), mineral materials, or WPC (Wood Plastic Composites).

25. The set of panels according to claim 14, wherein the panels are rectangular and two remaining opposite edges of each panel have a tongue and a groove, respectively, which are configured to couple similar panels along said edges by angling the tongue in the groove, or wherein two remaining opposite edges of each panel are configured with the male part and the female part, to couple the panels by a displacement substantially perpendicular to the front faces of the panels.

26. A set of mutually lockable panels comprising:

a first panel having a front face, a back face and an edge including a male part which is directed in a direction from the front face of the first panel to the back face of the first panel; and a second panel having a front face, a back face and an edge including a female part configured to receive the male part of the first panel in unlocked condition of the panels;

wherein the male part has an outer side which, in a locked condition of the panels, is directed to the second panel, and an opposite inner side which is provided with a locking surface;

wherein the female part comprises a locking member, wherein the locking member has a stop surface, which stop surface cooperates with the locking surface of the male part in locked condition of the panels so as to lock the panels with respect to each other at least in a direction substantially perpendicular to the locking surface and the stop surface; and wherein the locking member is formed integral with the second panel;

wherein the edge of the first panel comprises a male part and a groove;

wherein the groove is configured for receiving the locking member of the female part, wherein the groove comprises a groove wall at a proximal end of the groove;

wherein in the locked condition the locking member is maintained in position with respect to the first and second panel by a holding element comprising a snap fastener, wherein the snap fastener is provided by a protrusion on the groove wall of the first panel that fits behind an inclined portion at the outer side of the locking member;

wherein the female part comprises a bendable portion configured to move the locking member with respect to a rest of the second panel by bending the bendable portion, wherein the bendable portion is formed integral with the second panel, wherein the bendable portion is bendable with respect to a bending axis that extends substantially parallel to the edge of the second panel;

wherein the second panel comprises a lip, wherein the locking member is connected to the second panels by means of said lip, wherein the lip defines a first recess along the back face, said recess is located at a distal end of the locking member and extending proximally to beyond the locking member.

27. The set of panels according to claim 26, wherein the stop surface comprises a first contact surface, wherein the locking surface comprises a second contact surface, wherein in locked condition of the panels the first contact surface contacts the second contact surface, wherein in unlocked condition of the panels, the angle between the first contact surface and the front face differs from the angle between the second contact surface and the front face.

28. The set of panels according to claim 27, wherein in the locked condition of the panels the first contact surface contacts the second contact surface in a plane that is not substantially perpendicular to the front face of the locked panels.

29. The set of panels according to claim 26, wherein in locked condition the stop surface and the locking surface exert a pressure force upon each other.

30. The set of panels according to claim 29, wherein the pressure force is provided by the locking member being in a bent condition.

31. The set of panels according claim 26, wherein the outer side of the male part and an edge portion of the second panel which is opposite thereto in the locked condition of the panels are provided with a snap fastener configured to mutually lock the first panel to the second panel in a direction substantially perpendicular to the front faces of the panels.

32. The set of panels according to claim 31, wherein the snap fastener is provided by a protrusion at the outer side of the male part that fits in a recess in the edge portion of the second panel.

33. The set of panels according to claim 26, wherein the male part and the female part are dimensioned such that in a locked condition of the panels the locking member presses the outer side of the male part against the second panel.

34. The set of panels according to claim 26, wherein the panels are made of a material selected from LVT (Luxury Vinyl Tile), MDF (Medium Density Fiberboard), HDF (High Density Fiberboard), mineral materials, or WPC (Wood Plastic Composites).

35. The set of panels according to claim 26, wherein the panels are rectangular and two remaining opposite edges of each panel have a tongue and a groove, respectively, which are configured to couple similar panels along said edges by angling the tongue in the groove, or wherein two remaining opposite edges of each panel are configured with the male part and the female part, to couple the panels by a displacement substantially perpendicular to the front faces of the panels.

* * * * *